US009181063B2

(12) United States Patent
Hoshino et al.

(10) Patent No.: US 9,181,063 B2
(45) Date of Patent: Nov. 10, 2015

(54) SHEET PROCESSING APPARATUS, IMAGE FORMING SYSTEM, AND SHEET-BUNDLE ADDITIONAL FOLDING METHOD

(71) Applicants: Tomomichi Hoshino, Kanagawa (JP); Kiyoshi Hata, Tokyo (JP); Keisuke Sugiyama, Tokyo (JP); Atsushi Kikuchi, Kanagawa (JP); Mamoru Kambayashi, Tokyo (JP); Makoto Hidaka, Tokyo (JP); Shohichi Satoh, Kanagawa (JP); Satoshi Saito, Kanagawa (JP); Takao Watanabe, Kanagawa (JP); Takuya Sano, Kanagawa (JP)

(72) Inventors: Tomomichi Hoshino, Kanagawa (JP); Kiyoshi Hata, Tokyo (JP); Keisuke Sugiyama, Tokyo (JP); Atsushi Kikuchi, Kanagawa (JP); Mamoru Kambayashi, Tokyo (JP); Makoto Hidaka, Tokyo (JP); Shohichi Satoh, Kanagawa (JP); Satoshi Saito, Kanagawa (JP); Takao Watanabe, Kanagawa (JP); Takuya Sano, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/159,090

(22) Filed: Jan. 20, 2014

(65) Prior Publication Data

US 2014/0206519 A1 Jul. 24, 2014

(30) Foreign Application Priority Data

Jan. 18, 2013 (JP) ..... 2013-007726
Oct. 30, 2013 (JP) ..... 2013-225737

(51) Int. Cl.

| | |
|---|---|
| ***B65H 45/18*** | (2006.01) |
| ***B31F 1/00*** | (2006.01) |
| ***B65H 45/12*** | (2006.01) |
| ***B65H 45/04*** | (2006.01) |
| ***B65H 37/04*** | (2006.01) |

(52) U.S. Cl.

CPC *B65H 45/18* (2013.01); *B31F 1/00* (2013.01); *B31F 1/0006* (2013.01); *B31F 1/0035* (2013.01); *B65H 37/04* (2013.01); *B65H 45/04* (2013.01); *B65H 45/12* (2013.01); *B65H 2301/51232* (2013.01); *B65H 2701/13212* (2013.01); *B65H 2801/27* (2013.01)

(58) Field of Classification Search

CPC ..... B31F 1/00; B31F 1/0006; B31F 1/0035; B65H 45/12; B65H 45/04; B65H 2801/27
USPC ..... 270/32, 45, 58.07
See application file for complete search history.

(56) References Cited

U.S. PATENT DOCUMENTS 5,520,604 A * 5/1996 Reist ..... 493/422
8,002,255 B2 * 8/2011 Kawaguchi et al. ..... 270/45

(Continued)

FOREIGN PATENT DOCUMENTS

EP 2634125 A1 * 9/2013
EP 2644547 A1 * 10/2013

(Continued)

*Primary Examiner* — Leslie A Nicholson, III

(74) *Attorney, Agent, or Firm* — Harness, Dickey & Pierce, P.L.C.

(57) ABSTRACT

A sheet processing apparatus includes a pressing unit including a first pressing member and a second pressing member. The pressing unit is configured to press a fold in a folded sheet bundle by holding the fold between the first pressing member and the second pressing member. The sheet processing apparatus also includes a moving unit configured to move a pressing position of the pressing unit in a direction of the fold in the sheet bundle; and a position changing unit configured to change relative positions of the first pressing member and the second pressing member in the direction of the fold in the sheet bundle.

13 Claims, 27 Drawing Sheets

(56) References Cited

U.S. PATENT DOCUMENTS

| | | | | |
|---|---|---|---|---|
| 8,342,497 | B2 * | 1/2013 | Abe | 270/45 |
| 2003/0151187 | A1 | 8/2003 | Suzuki et al. | |
| 2003/0160376 | A1 | 8/2003 | Yamada et al. | |
| 2003/0215275 | A1 | 11/2003 | Tamura et al. | |
| 2003/0219295 | A1 | 11/2003 | Saitoh et al. | |
| 2003/0234487 | A1 | 12/2003 | Tamura et al. | |
| 2004/0070133 | A1 | 4/2004 | Yamada et al. | |
| 2004/0104525 | A1 | 6/2004 | Suzuki et al. | |
| 2008/0315481 | A1 | 12/2008 | Iguchi et al. | |
| 2009/0200725 | A1 | 8/2009 | Tamura et al. | |
| 2011/0176849 | A1 * | 7/2011 | Abe | 399/408 |
| 2012/0190526 | A1 | 7/2012 | Terao | |

FOREIGN PATENT DOCUMENTS

| | | |
|---|---|---|
| JP | 2009-001428 | 1/2009 |
| JP | 2009-190824 | 8/2009 |
| JP | 2012-020882 | 2/2012 |
| JP | 2012-153530 | 8/2012 |

* cited by examiner (a)

(b)

(c)

(d)

SHEET PROCESSING APPARATUS, IMAGE FORMING SYSTEM, AND SHEET-BUNDLE ADDITIONAL FOLDING METHOD

CROSS-REFERENCE TO RELATED APPLICATIONS

The present application claims priority to and incorporates by reference the entire contents of Japanese Patent Application No. 2013-007726 filed in Japan on Jan. 18, 2013 and Japanese Patent Application No. 2013-225737 filed in Japan on Oct. 30, 2013.

BACKGROUND OF THE INVENTION

1. Field of the Invention

The present invention relates to a sheet processing apparatus, an image forming system, and a sheet-bundle additional folding method, and more particularly, to a sheet processing apparatus having a function of folding a sheet-like recording medium such as paper, recording paper, and transfer paper (hereinafter, referred to simply as a "sheet" in the present specification), an image forming system including the sheet processing apparatus, and a sheet-bundle additional folding method implemented by the sheet processing apparatus.

2. Description of the Related Art

Conventionally, in post-processing apparatuses used in combination with an image forming apparatus such as a copier, there are ones that bind a bundle of one or more sheets into a saddle-stitched booklet by saddle-stitching and folding the center of the sheet bundle with use of a pair of folding rollers installed parallel to each other in a sheet folding direction.

Furthermore, there is already known an additional folding technique for enhancing a fold in a folded saddle-stitched booklet by moving an additional folding roller along the fold after saddle-stitching and center-folding are performed on a sheet bundle.

As one of such additional folding techniques, for example, a technology disclosed in Japanese Patent Application Laid-open No. 2012-153530 is well known.

A sheet processing apparatus according to this technology includes a folding roller unit, an additional folding roller unit, and a drive unit. The folding roller unit makes a fold in a sheet while the sheet is passing through a nip between a pair of rollers. The additional folding roller unit includes first to third rollers: the first roller installed on the side of a first plane perpendicular to a direction of conveying a sheet bundle folded by the folding roller unit and the second and third rollers installed on the side of a second plane perpendicular to the sheet-bundle conveying direction; the second and third rollers each form a nip with the first roller. The drive unit drives the additional folding roller unit to move along the fold in a state where the sheet bundle is held in the nip between the first and second rollers and the nip between the first and third rollers. This configuration enables the sheet processing apparatus to perform additional folding sufficiently when performing the additional folding on a sheet bundle.

Specifically, the additional folding roller unit described in Patent document 1 includes three additional folding rollers, and is driven to move along a fold in a sheet bundle in a state where the fold is held between the rollers. In this regard, a roller having a larger diameter than those of the second and third rollers is used as the first roller.

In a case of using three folding rollers in this way, two nips are formed, and respective tangential angles of the nips are not parallel. Therefore, a direction of force applied to a staple differs between the nips, and therefore the staple may be deformed.

There is a method for enhancing a fold by shifting an angle between a direction of the tangent to a pair of additional folding rollers and a thickness direction of a sheet bundle from 90 degrees; however, in this enhancing method, a staple may be deformed depending on the position of the staple in the additional folding.

Namely, if we focus on enhancing a fold, a staple may be deformed; on the other hand, if we focus on preventing deformation of a staple, enhancement of a fold may be insufficient.

Therefore, there is a need for a sheet processing apparatus to enable a user to make a choice between emphasis on enhancement of a fold and emphasis on suppression of staple deformation in accordance with user's intention.

SUMMARY OF THE INVENTION

It is an object of the present invention to at least partially solve the problems in the conventional technology.

According to an embodiment, there is provided a sheet processing apparatus that includes a pressing unit including a first pressing member and a second pressing member, the pressing unit being configured to press a fold in a folded sheet bundle by holding the fold between the first pressing member and the second pressing member; a moving unit configured to move a pressing position of the pressing unit in a direction of the fold in the sheet bundle; and a position changing unit configured to change relative positions of the first pressing member and the second pressing member in the direction of the fold in the sheet bundle.

According to another embodiment, there is provided an image forming system that includes the sheet processing apparatus according to the above embodiment.

According to still another embodiment, there is provided a sheet-bundle additional folding method for a sheet processing apparatus that includes a pressing unit configured to press a fold in a folded sheet bundle by holding the fold between a first pressing member and a second pressing member, and a moving unit configured to move a pressing position of the pressing unit in a direction of the fold in the sheet bundle. The sheet-bundle additional folding method includes changing relative positions of the first pressing member and the second pressing member in the direction of the fold in the sheet bundle.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The present invention enables a user to make a choice between enhancement of a fold in a sheet bundle by changing the relative positions of a pair of first and second pressing members in a sheet-bundle folding direction and suppression of staple deformation in accordance with user's intention.

An exemplary embodiment of the present invention will be explained below with reference to accompanying drawings.

Figure 1:
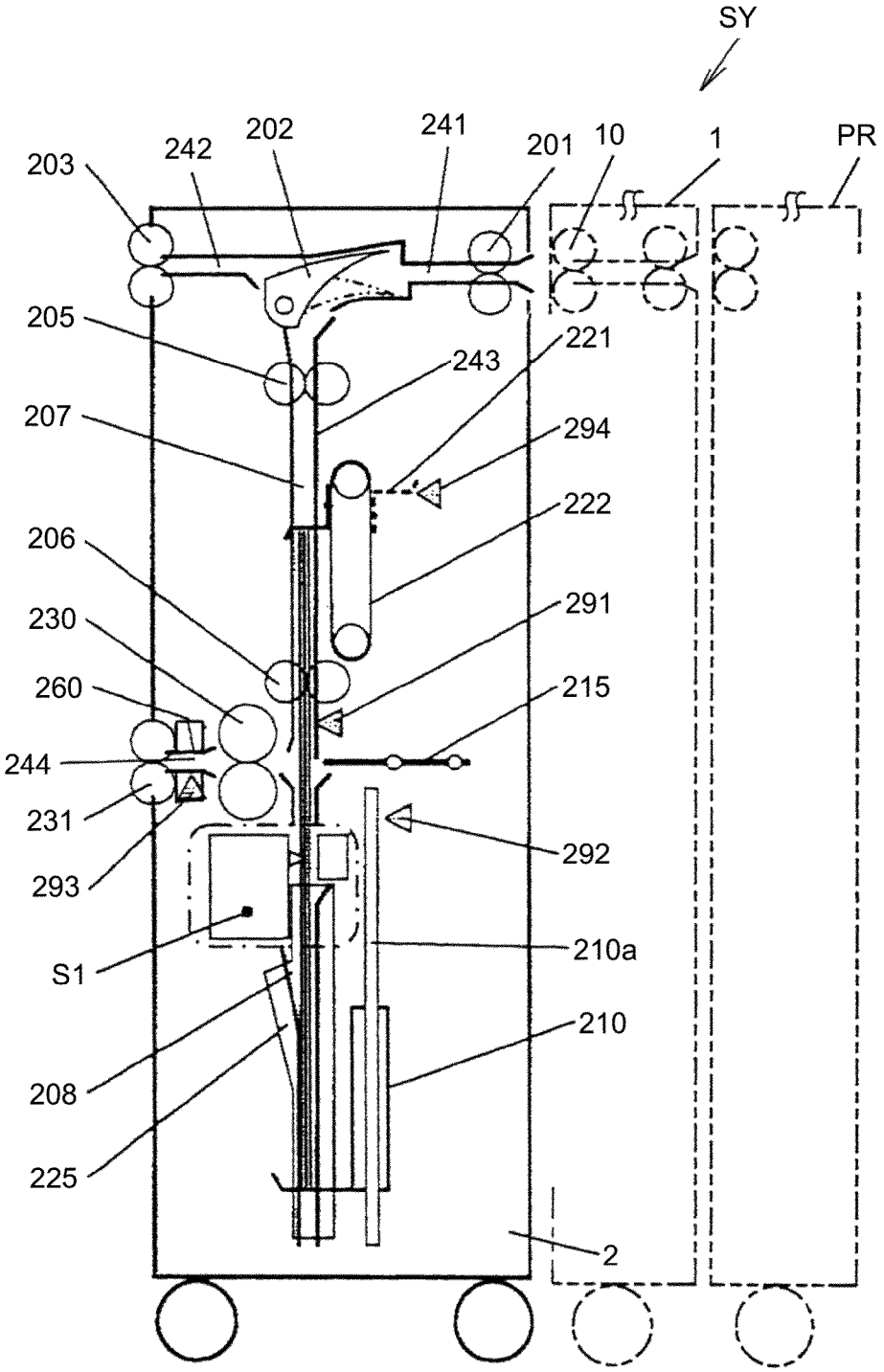
FIG. 1 is a diagram illustrating a system configuration of an image processing system composed of an image forming apparatus and multiple sheet processing apparatuses according to an embodiment of the present invention.

FIG. 1 is a diagram illustrating a system configuration of an image forming system composed of an image forming apparatus and multiple sheet processing apparatuses according to the embodiment. In the present embodiment, in the subsequent stage of an image forming apparatus PR, first and second sheet post-processing apparatuses 1 and 2 are connected to the image forming apparatus PR in this order.

The first sheet post-processing apparatus 1 is a sheet post-processing apparatus having a sheet-bundle making function of receiving sheets one by one from the image forming apparatus PR and sequentially aligning and laying the sheets on top of another, thereby creating a sheet bundle in a stack unit, and discharges the sheet bundle into the subsequent second sheet post-processing apparatus 2 through a sheet-bundle discharge roller 10. The second sheet post-processing apparatus 2 is a saddle-stitch bookbinding apparatus that receives a sheet bundle conveyed thereto and performs saddle-stitching and center-folding on the sheet bundle. In the present specification, the second sheet post-processing apparatus 2 is also referred to as the saddle-stitch bookbinding apparatus.

The saddle-stitch bookbinding apparatus 2 discharges a finished booklet (the bound sheet bundle) to the outside or a subsequent sheet processing apparatus. The image forming apparatus PR forms a visible image on a sheet-like recording medium on the basis of input image data or image data of a scanned image. The image forming apparatus PR corresponds to, for example, a copier, a printer, a facsimile device, or a digital multifunction peripheral having at least two of these functions. An image forming method of the image forming apparatus PR can be any publicly-known methods, such as an electrophotographic method and a droplet injection method.

As illustrated in FIG. 1, the saddle-stitch bookbinding apparatus 2 includes an entrance path 241, a sheet-through path 242, and a center-folding path 243. On the upmost stream of the entrance path 241 in a sheet conveying direction, an entrance roller 201 is installed; an aligned sheet bundle conveyed through the sheet-bundle discharge roller 10 of the first sheet post-processing apparatus 1 is conveyed into the saddle-stitch bookbinding apparatus 2 through the entrance roller 201. Incidentally, in the description below, the upstream side in the sheet conveying direction is referred to simply as "the upstream side", and the downstream side in the sheet conveying direction is referred to simply as "the downstream side".

On the downstream side of the entrance roller 201 in the entrance path 241, a bifurcating claw 202 is installed. This bifurcating claw 202 is horizontally placed, and bifurcates the conveying direction of a sheet bundle into the sheet-through path 242 and the center-folding path 243. The sheet-through path 242 is a sheet path which extends horizontally from the entrance path 241 and leads a sheet bundle into a subsequent processing apparatus (not illustrated) or a copy receiving tray, and the sheet bundle is discharged into the subsequent stage through an upper discharge roller 203. The center-folding path 243 is a sheet path which extends vertically downward from the bifurcating claw 202 and is for performing saddle-stitching and center-folding on a sheet bundle.

The center-folding path 243 includes an upper bundle conveyance guide plate 207 for guiding a sheet bundle on the upper side of a folding plate 215 for center-folding and a lower bundle conveyance guide plate 208 for guiding the sheet bundle on the lower part of the folding plate 215. On the upper bundle conveyance guide plate 207, an upper bundle conveyance roller 205, a trailing-end tapping claw 221, and a lower bundle conveyance roller 206 are installed in this order from the above. The trailing-end tapping claw 221 is placed to stand straight to a trailing-end tapping claw drive belt 222 driven by a drive motor (not illustrated). In accordance with the reciprocating rotation movement of the trailing-end tapping claw drive belt 222, the trailing-end tapping claw 221 taps (pushes) the trailing end of a sheet bundle to the side of a movable fence to be described later, thereby aligning the sheet bundle. Incidentally, when a sheet bundle is conveyed into the center-folding path 243 and when a sheet bundle is lifted up to be center-folded, the trailing-end tapping claw 221 is retracted from the center-folding path 243 on the upper bundle conveyance guide plate 207 (a dashed line position in FIG. 1).

A reference numeral 294 denotes a trailing-end tapping claw HP sensor for detecting the home position of the trailing-end tapping claw 221, and detects the dashed line position in FIG. 1 (a solid line position in FIG. 2) as the home position of the trailing-end tapping claw 221 retracted from the center-folding path 243. The trailing-end tapping claw 221 is controlled on the basis of this home position.

On the lower bundle conveyance guide plate 208, a saddle-stitch stapler S1, a pair of saddle-stitch jogger fences 225, and a movable fence 210 are installed in this order from the above. The lower bundle conveyance guide plate 208 is a guide plate for receiving a sheet bundle conveyed through the upper bundle conveyance guide plate 207; the pair of saddle-stitch jogger fences 225 is installed in a width direction of the lower bundle conveyance guide plate 208, and the movable fence 210 is movably installed on the lower part of the lower bundle conveyance guide plate 208 so that the movable fence 210 can move up and down to come in contact with (support) the leading end of a sheet bundle.

The saddle-stitch stapler S1 is a stapler for binding the center of a sheet bundle. In a state where the movable fence 210 supports the leading end of a sheet bundle, the movable fence 210 moves vertically to bring the center position of the sheet bundle to the position opposed to the saddle-stitch stapler S1, and the sheet bundle is stapled, i.e., saddle-stitched in the position. The movable fence 210 is supported by a movable-fence drive mechanism 210*a*, and can move from the position opposed to a movable fence HP sensor 292 located on the upper side of the lower bundle conveyance guide plate 208 to the bottom of the lower bundle conveyance guide plate 208. As a movable range of the movable fence 210 with which the leading end of a sheet bundle has contact, a stroke enough to process any sizes of sheets from the maximum size to the minimum size that the saddle-stitch bookbinding apparatus 2 can process is ensured. Incidentally, as the movable-fence drive mechanism 210*a*, for example, a rack-and-pinion mechanism is used.

In between the upper and lower bundle conveyance guide plates 207 and 208, i.e., roughly in the center of the center-folding path 243, the folding plate 215, a pair of folding rollers 230, an additional folding roller unit 260, and a lower sheet discharge roller 231 are installed. The additional folding roller unit 260 includes additional folding rollers which are arranged one above the other across a sheet discharge path running between the pair of folding rollers 230 and the lower sheet discharge roller 231. The folding plate 215 can reciprocate in a horizontal direction, and a nip between the pair of folding rollers 230 is located in a reciprocating direction of the folding plate 215 when a folding operation is performed, and a sheet discharge path 244 is provided as an extension of the nip. The lower sheet discharge roller 231 is installed on the downmost stream of the sheet discharge path 244, and discharges a folded sheet bundle to the subsequent stage.

A sheet-bundle detection sensor 291 is installed on the side of the lower end of the upper bundle conveyance guide plate 207, and detects the leading end of a sheet bundle which is conveyed into the center-folding path 243 and passes through the center-folding position. Furthermore, a fold passage sensor 293 is installed in the sheet discharge path 244, and detects the leading end of a center-folded sheet bundle, thereby recognizing the passage of the sheet bundle.

Generally, in the saddle-stitch bookbinding apparatus 2 configured as illustrated in FIG. 1, saddle-stitching and center-folding are performed as illustrated in FIGS. 2 to 6. Namely, when saddle-stitching/center-folding is selected through an operation panel (not illustrated) of the image forming apparatus PR, a sheet bundle to be subjected to the selected saddle-stitching/center-folding is guided to the side of the center-folding path 243 by the bifurcating claw 202 biased in a counterclockwise direction. Incidentally, the bifurcating claw 202 is driven by a solenoid. Alternatively, the bifurcating claw 202 can be driven by a motor instead of the solenoid.

Figure 2:
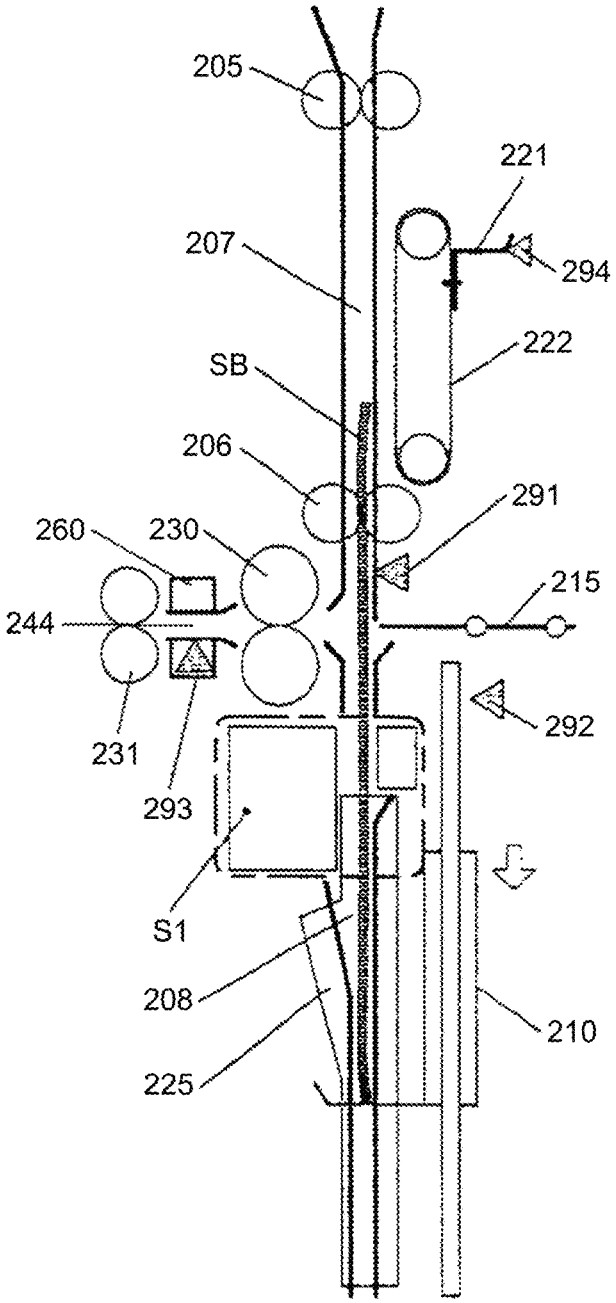
FIG. 2 is a diagram for explaining operation of a saddle-stitch bookbinding apparatus, and illustrates a state of the saddle-stitch bookbinding apparatus when a sheet bundle has been conveyed into a center-folding path.

A sheet bundle SB having been conveyed into the center-folding path 243 is conveyed to the downstream of the center-folding path 243 by the entrance roller 201 and the upper bundle conveyance roller 205, and further conveyed to the position where after the sheet-bundle detection sensor 291 has confirmed the passage of the sheet bundle SB, the sheet bundle SB is caused to bump the leading end into the movable fence 210 by the lower bundle conveyance roller 206 as illustrated in FIG. 2 and kept in this state (i.e., kept in contact with the movable fence 210). At the time, the movable fence 210 waits in a stop position which varies according to sheet size information received from the image forming apparatus PR, that is, information on the size of the sheet bundle SB in the conveying direction here. At this time, in FIG. 2, the lower bundle conveyance roller 206 holds the sheet bundle SB in a nip between the lower bundle conveyance rollers 206, and the trailing-end tapping claw 221 waits in the home position.

Figure 3:
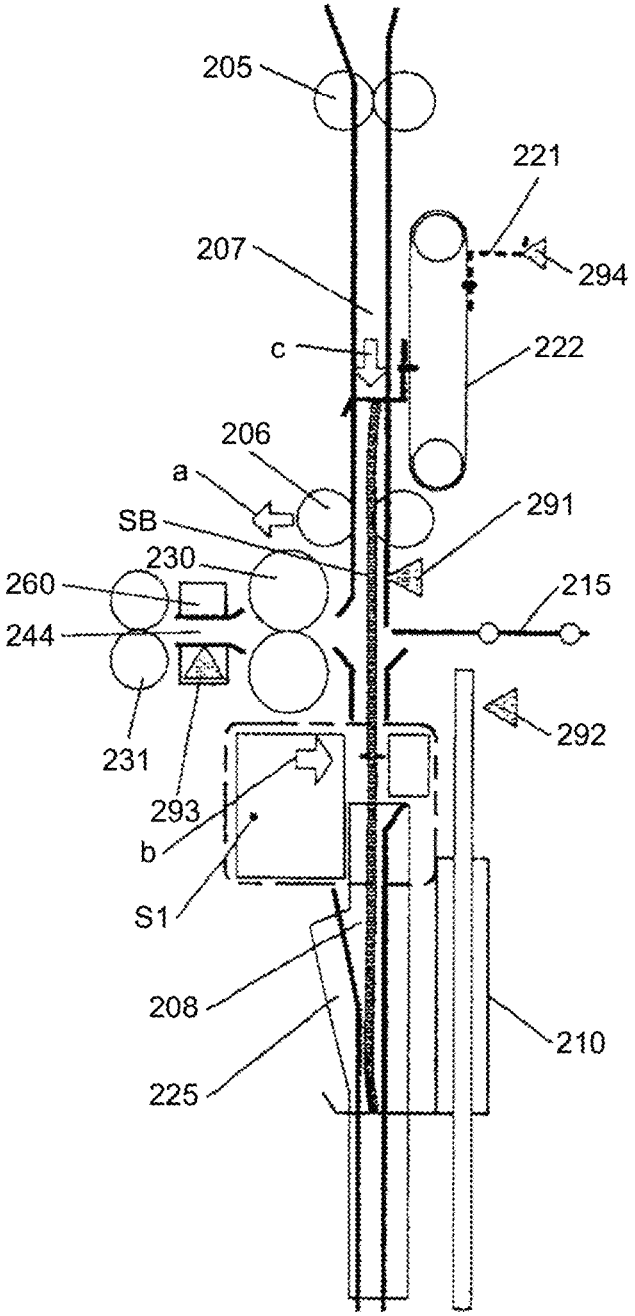
FIG. 3 is a diagram for explaining the operation of the saddle-stitch bookbinding apparatus, and illustrates a state of the saddle-stitch bookbinding apparatus when saddle-stitching the sheet bundle.

In this state, when the sheet bundle SB is released from nip pressure applied by the lower bundle conveyance roller 206 (the lower bundle conveyance roller 206 moves in a direction of arrow a) as illustrated in FIG. 3, and the sheet bundle SB is stacked in a state where the leading end is in contact with the movable fence 210 and the trailing end is free, the trailing-end tapping claw 221 is driven and taps the trailing end of the sheet bundle SB, thereby performing eventual alignment of the sheet bundle SB in the conveying direction (in a direction of arrow c).

After that, alignment of the sheet bundle SB in the width direction (a direction perpendicular to the sheet conveying direction) by the saddle-stitch jogger fences 225 and alignment of the sheet bundle SB in the conveying direction by the movable fence 210 and the trailing-end tapping claw 221 are executed, and the alignment operation of the sheet bundle SB in the width direction and the conveying direction is completed. At this time, respective pushing amounts of the trailing-end tapping claw 221 and the saddle-stitch jogger fences 225 are changed to optimum values on the basis of information on the sheet size, the number of sheets of the sheet bundle, and the thickness of the sheet bundle, and the alignment operation is performed.

If a bundle is thick, space in the sheet path is reduced; therefore, it is often the case that the bundle cannot be sufficiently aligned by one alignment operation. Therefore, in such a case, the number of alignments is increased. This makes possible to achieve a better alignment state. Furthermore, the time required to sequentially superpose sheets on the upstream side increases with increase in the number of sheets; therefore, it takes longer to receive the next sheet bundle SB. As a result, even if the number of alignments is increased, there is no time loss in the system, so it is possible to efficiently achieve a better alignment state. Therefore, it is also possible to control the number of alignments according to the processing time on the upstream.

Incidentally, the waiting position of the movable fence 210 is generally set to such a position that the saddle-stitch position of the sheet bundle SB is opposed to the binding position of the saddle-stitch stapler S1. By aligning the sheet bundle SB in this position, the sheet bundle SB can be bound in the stacked position without moving the movable fence 210 to the saddle-stitch position of the sheet bundle SB. Therefore, in this waiting position, a stitcher of the saddle-stitch stapler S1 is driven to move in a direction of arrow b, i.e., to the center of the sheet bundle SB, and saddle-stitches the sheet bundle SB with a clincher.

The movable fence 210 is positioned by controlling pulses from the movable fence HP sensor 292, and the trailing-end tapping claw 221 is positioned by controlling pulses from the trailing-end tapping claw HP sensor 294. The positioning controls on the movable fence 210 and the trailing-end tapping claw 221 are executed by a CPU 200*a* of a control circuit 200 included in the saddle-stitch bookbinding apparatus 2 (see FIG. 32).

Figure 4:
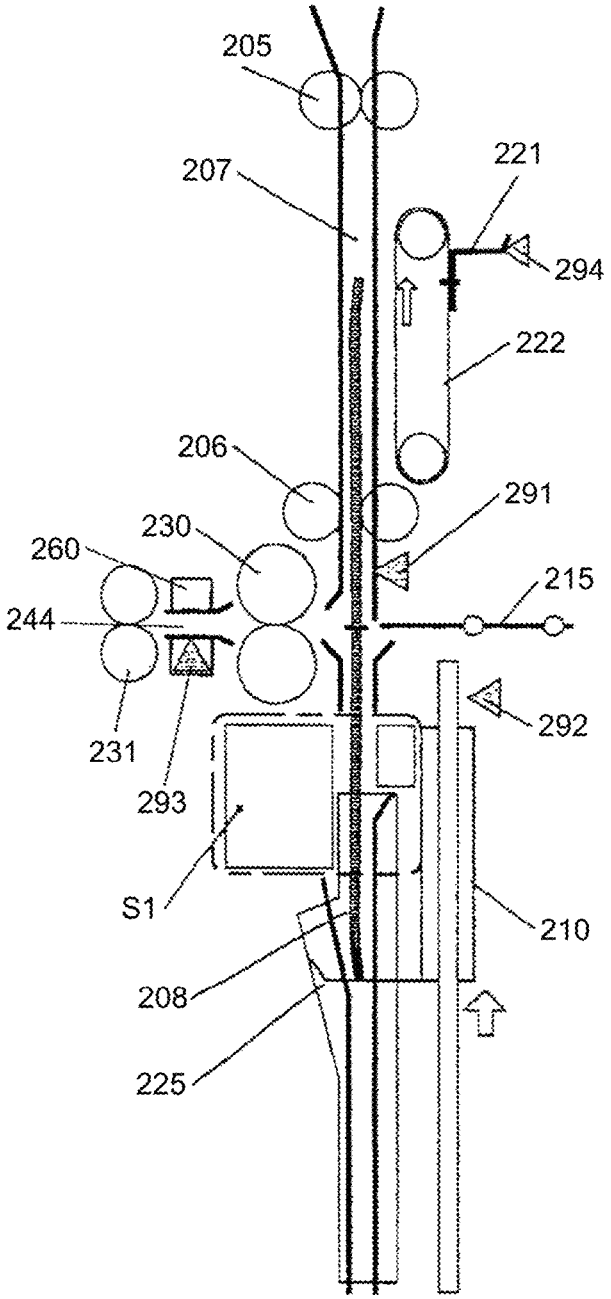
FIG. 4 is a diagram for explaining the operation of the saddle-stitch bookbinding apparatus, and illustrates a state of the saddle-stitch bookbinding apparatus when the sheet bundle has been moved to the center-folding position.

The sheet bundle SB which has been saddle-stitched in the state illustrated in FIG. 3 is conveyed to the position at which the saddle-stitched position (the center position of the sheet bundle SB in the conveying direction) is opposed to the folding plate 215 in accordance with the upward movement of the movable fence 210 in a state where the sheet bundle SB is released from pressure applied by the lower bundle conveyance roller 206 as illustrated in FIG. 4. This position is also controlled on the basis of the position detected by the movable fence HP sensor 292.

Figure 5:
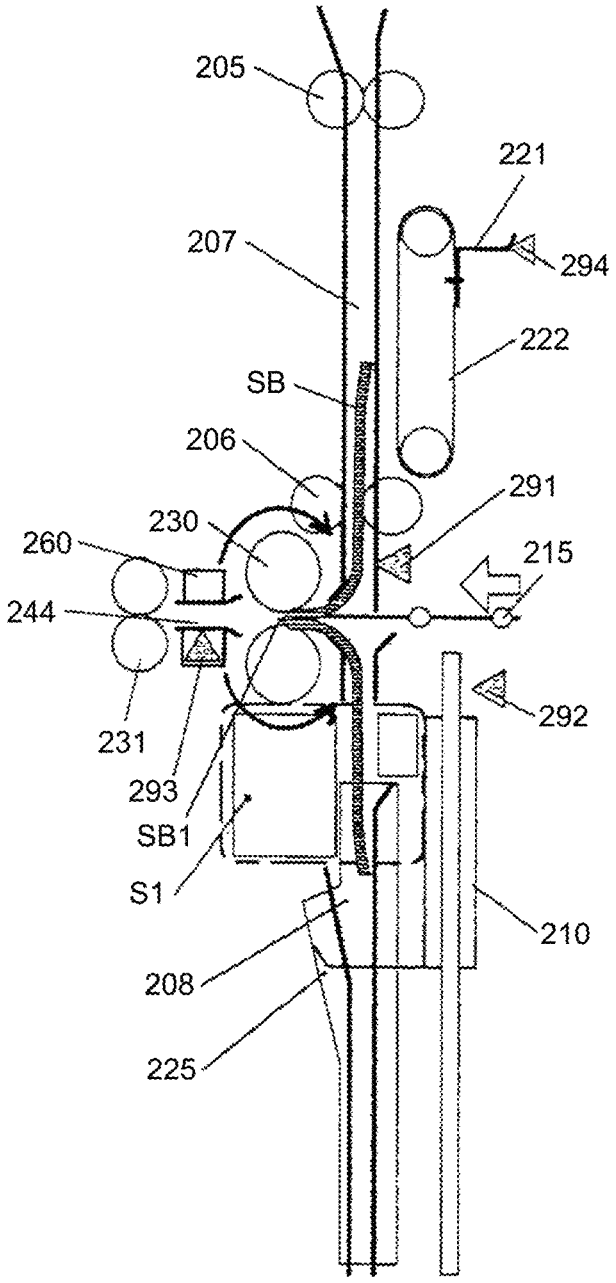
FIG. 5 is a diagram for explaining the operation of the saddle-stitch bookbinding apparatus, and illustrates a state of the saddle-stitch bookbinding apparatus when performing a center-folding process on the sheet bundle.

When the sheet bundle SB has reached the position illustrated in FIG. 4, the folding plate 215 moves in a direction of the nip between the pair of folding rollers 230 as illustrated in FIG. 5, and comes in contact with near a staple portion of the sheet bundle SB at about right angle and pushes the sheet bundle SB to the side of the nip. By being pushed by the folding plate 215, the sheet bundle SB is guided to the nip between the pair of folding rollers 230, and is thrust into the nip between the pair of folding rollers 230 which are rotating. The pair of folding rollers 230 applies pressure to the sheet bundle SB thrust into the nip, and conveys the sheet bundle SB. Through this pressurized conveying operation, the sheet bundle SB is center-folded, and the simply-bound sheet bundle SB is formed. FIG. 5 illustrates a state of the saddle-stitch bookbinding apparatus 2 when the tip of a fold SB1 in the sheet bundle SB is held in the nip between the pair of folding rollers 230 and is pressurized.

Figure 6:
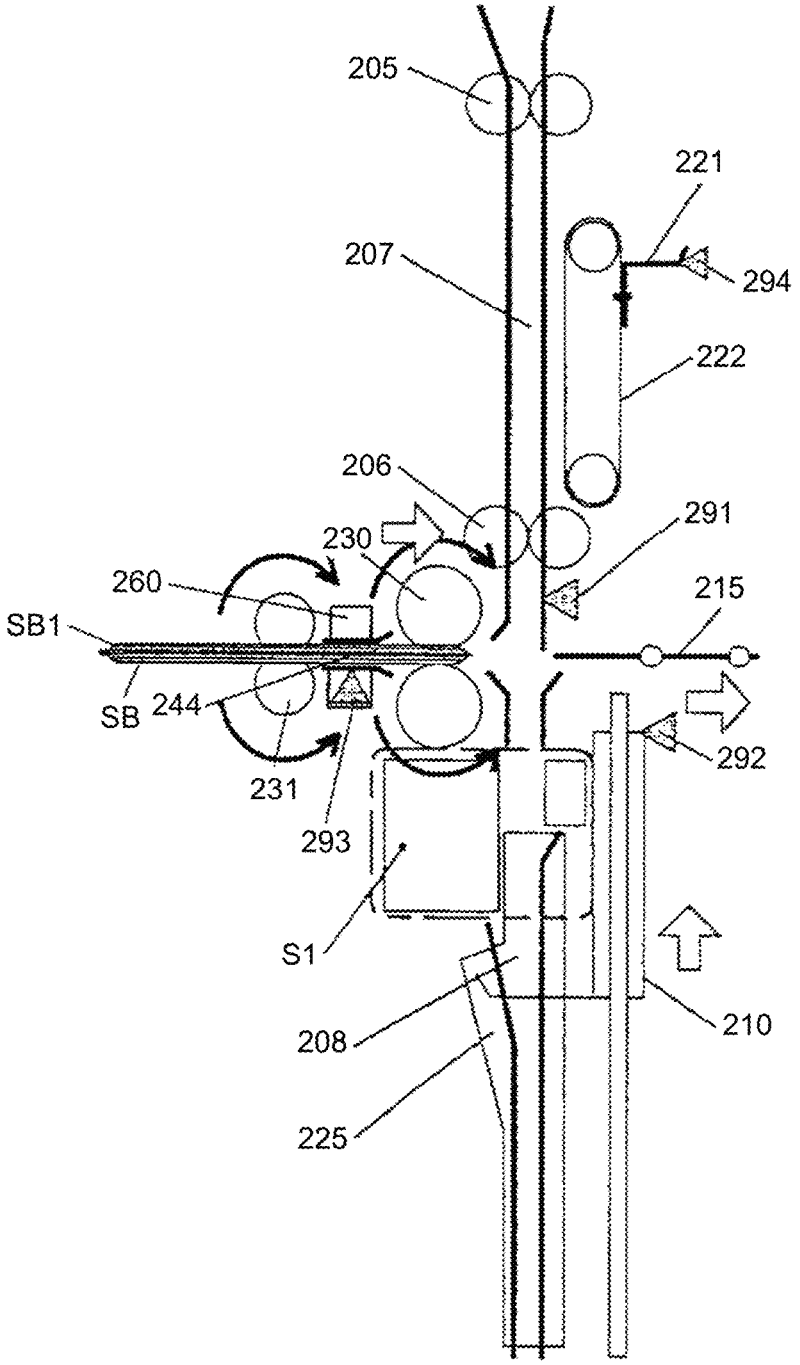
FIG. 6 is a diagram for explaining the operation of the saddle-stitch bookbinding apparatus, and illustrates a state of the saddle-stitch bookbinding apparatus when discharging the center-folded sheet bundle to the outside of the apparatus.

The sheet bundle SB having been folded in half in the state illustrated in FIG. 5 is conveyed by the pair of folding rollers 230 as illustrated in FIG. 6, and is discharged to the subsequent stage by being held between the lower sheet discharge rollers 231. At this time, when the trailing end of the sheet bundle SB has been detected by the fold passage sensor 293, the folding plate 215 and the movable fence 210 return to their respective home positions, and the lower bundle conveyance roller 206 returns to a pressure applying state to make themselves ready for arrival of the next sheet bundle SB. If the next job is the same in size and number of sheets, the movable fence 210 can again move to the position illustrated in FIG. 2 and wait in the position. Incidentally, these controls are also executed by the CPU 200*a* of the control circuit 200.

Figure 7:
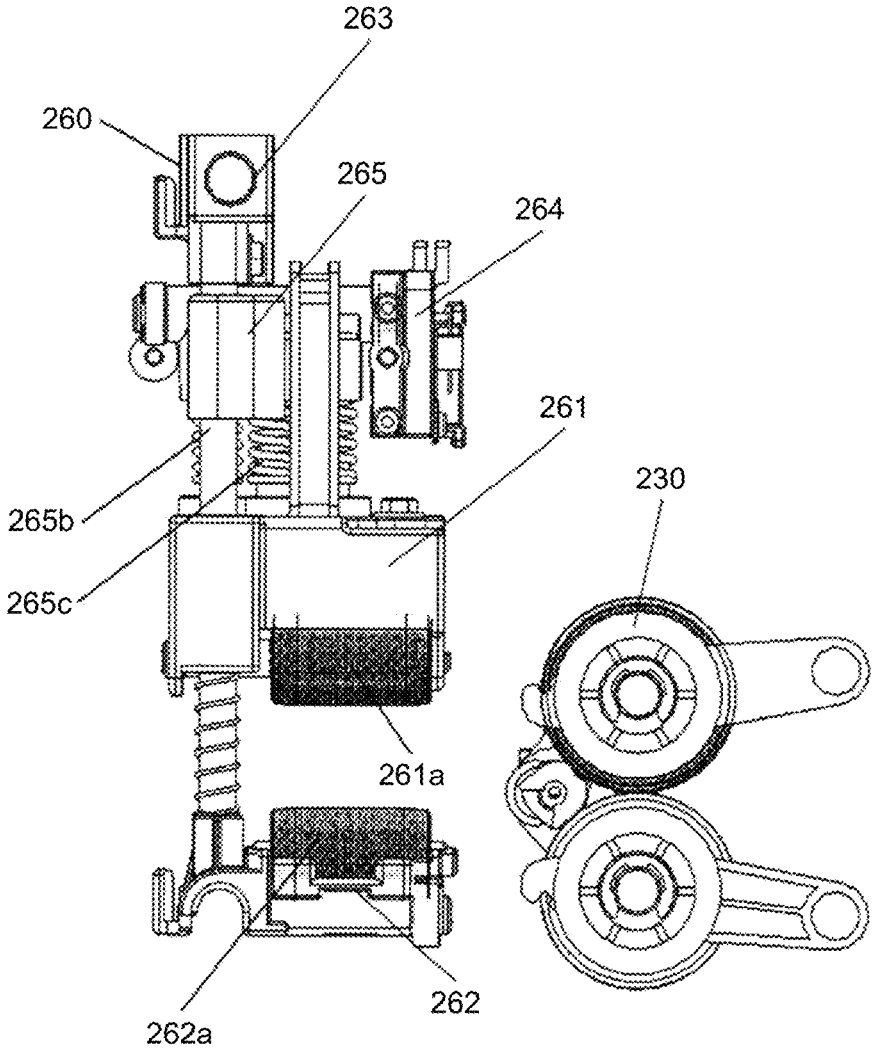
FIG. 7 is a front view of an additional folding roller unit and a pair of folding rollers.
Figure 8:
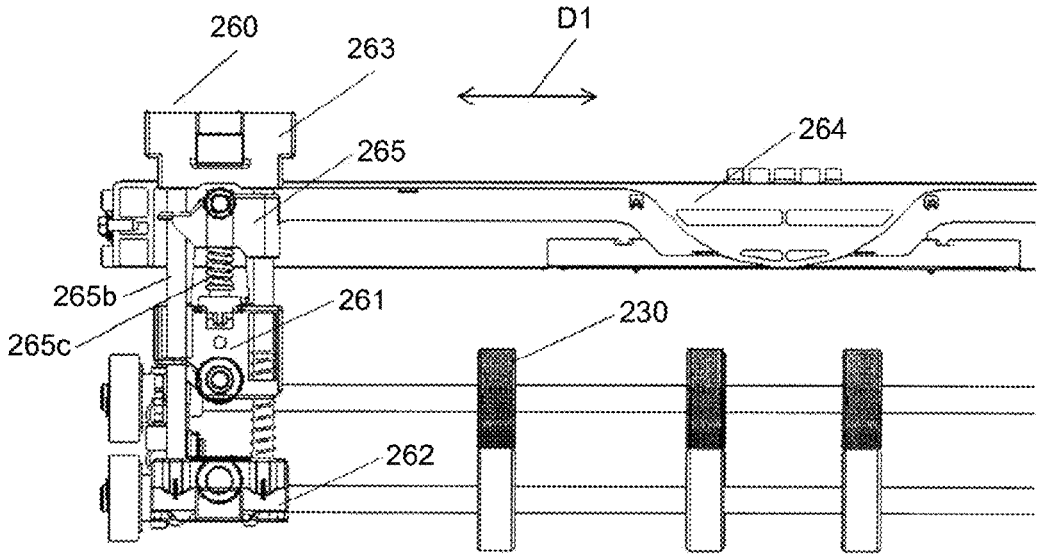
FIG. 8 is a side view of the additional folding roller unit and the pair of folding rollers illustrated in FIG. 7 viewed from the left.

FIG. 7 is a front view of the additional folding roller unit and the pair of folding rollers, and FIG. 8 is a side view of the additional folding roller unit and the pair of folding rollers illustrated in FIG. 7 viewed from the left. The additional folding roller unit 260 is installed in the sheet discharge path 244 between the pair of folding rollers 230 and the lower sheet discharge roller 231, and includes a unit moving mechanism 263, a guide member 264, and a pressing mechanism 265. The unit moving mechanism 263 reciprocates the additional folding unit 260 in a depth direction (a direction perpendicular to the sheet conveying direction) along the guide member 264 by means of a drive source (not illustrated) and a drive mechanism (not illustrated). The pressing mechanism 265 is a mechanism that applies pressure to a sheet bundle SB from above and below thereby pressing the sheet bundle SB, and includes an upper additional folding roller unit 261 and a lower additional folding roller unit 262.

The upper additional folding roller unit 261 is movably supported by a supporting member 265*b* so that the upper additional folding roller unit 261 can move up and down with respect to the unit moving mechanism 263, and the lower additional folding roller unit 262 is immovably attached to the lower end of the supporting member 265*b* of the pressing mechanism 265. An upper additional folding roller 261*a* of the upper additional folding roller unit 261 can come in contact with a lower additional folding roller 262*a* in a state where the upper additional folding roller 261*a* applies pressure to the lower additional folding roller 262*a*, and applies pressure to the lower additional folding roller 262*a* in a state where a sheet bundle SB is held in a nip between the upper and lower additional folding rollers 261*a* and 262*a*. The applied pressure is given by a pressure applying spring 265*c* which applies pressure to the upper additional folding roller unit 261 with elastic force. Then, in the pressure applying state, the upper additional folding roller unit 261 moves in a width direction (a direction of arrow D in FIG. 8, an X direction in FIGS. 24 and 25: a folding direction) of the sheet bundle SB as will be described later, and performs additional folding on a fold SB1 in the sheet bundle SB.

Figure 9:
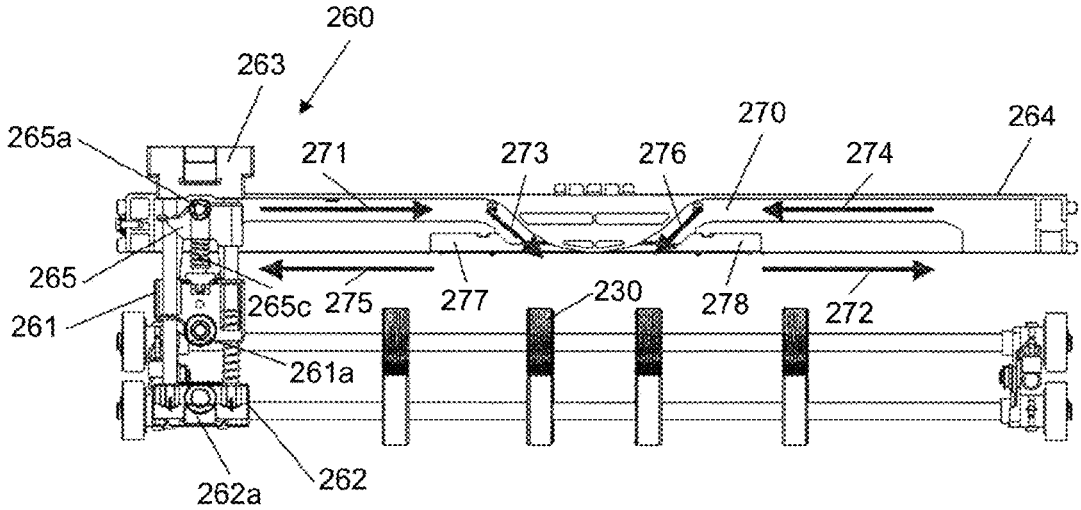
FIG. 9 is a diagram illustrating details of a guide member.

FIG. 9 is a diagram illustrating details of the guide member 264. The guide member 264 includes a guide path 270 for guiding the additional folding roller unit 260 in the width direction of a sheet bundle SB, and the guide path 270 includes six paths:

(1) a first guide path 271 for guiding the pressing mechanism 265 in a pressing cancel state at the time of forward movement;

(2) a second guide path 272 for guiding the pressing mechanism 265 in a pressing state at the time of forward movement;

(3) a third guide path 273 for switching the pressing mechanism 265 from the pressing cancel state to the pressing state at the time of forward movement;

(4) a fourth guide path 274 for guiding the pressing mechanism 265 in the pressing cancel state at the time of return movement;

(5) a fifth guide path 275 for guiding the pressing mechanism 265 in the pressing state at the time of return movement; and (6) a sixth guide path 276 for switching the pressing mechanism 265 from the pressing cancel state to the pressing state at the time of return movement.

Figure 10:
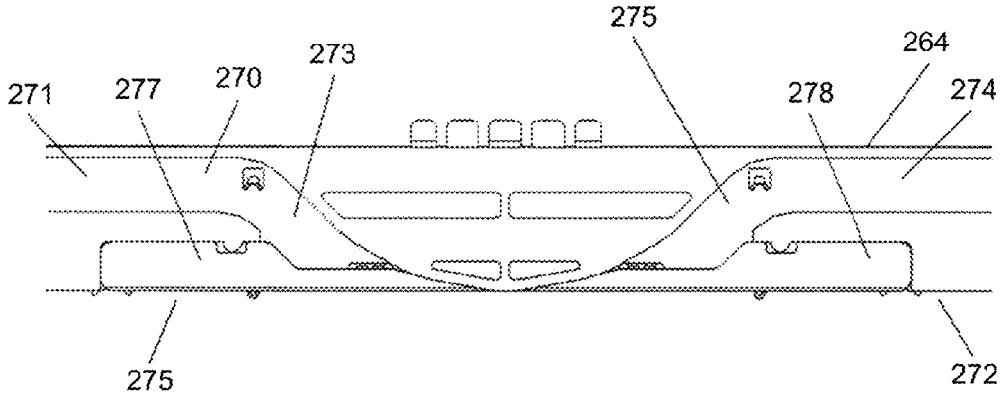
FIG. 10 is an enlarged view of a main section of the guide member illustrated in FIG. 9, and illustrates a state of the guide member before a path switching claw is switched.
Figure 11:
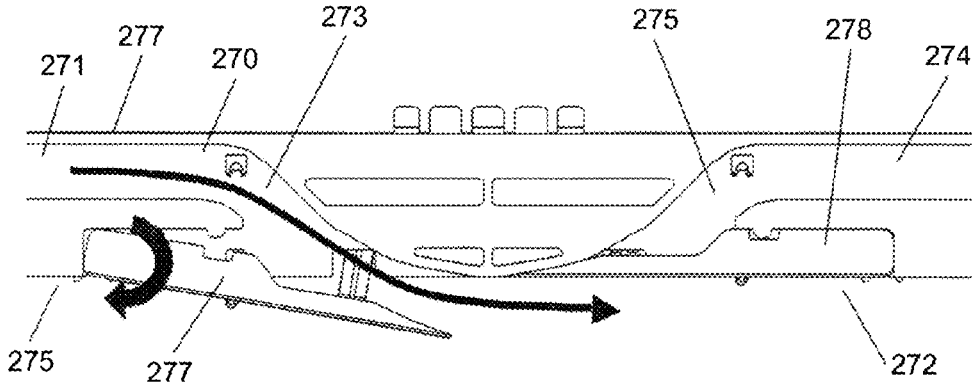
FIG. 11 is an enlarged view of the main section of the guide member illustrated in FIG. 9, and illustrates a state of the guide member when a first path switching claw has been switched.

FIGS. 10 and 11 are enlarged views of a main section of the guide member illustrated in FIG. 9. As illustrated in FIGS. 10 and 11, a first path switching claw 277 is installed at the point of intersection between the third guide path 273 and the second guide path 272, and a second path switching claw 278 is installed at the point of intersection between the sixth guide path 276 and the fifth guide path 275. As illustrated in FIG. 11, the first path switching claw 277 can switch from the third guide path 273 to the second guide path 272, and the second path switching claw 278 can switch from the sixth guide path 276 to the fifth guide path 275. However, the first path switching claw 277 cannot switch from the second guide path 272 to the third guide path 273, and the second path switching claw 278 cannot switch from the fifth guide path 275 to the sixth guide path 276. Namely, the first and second path switching claws 277 and 278 are configured not to switch the path in the opposite direction. Incidentally, an arrow illustrated in FIG. 11 indicates the movement locus of a guide pin 265*a*.

The reason why the pressing mechanism 265 moves along the guide path 270 is because the guide pin 265*a* of the pressing mechanism 265 is loosely fitted into the guide path 270 so that pressing mechanism 265 can move. Namely, the guide path 270 serves as a cam groove, and the guide pin 265*a* serves as a cam follower that shifts position while the pressing mechanism 265 moves along the cam groove.

FIGS. 12 to 22 are explanatory diagrams of an additional folding operation of the additional folding roller unit according to the present embodiment.

Figure 12:
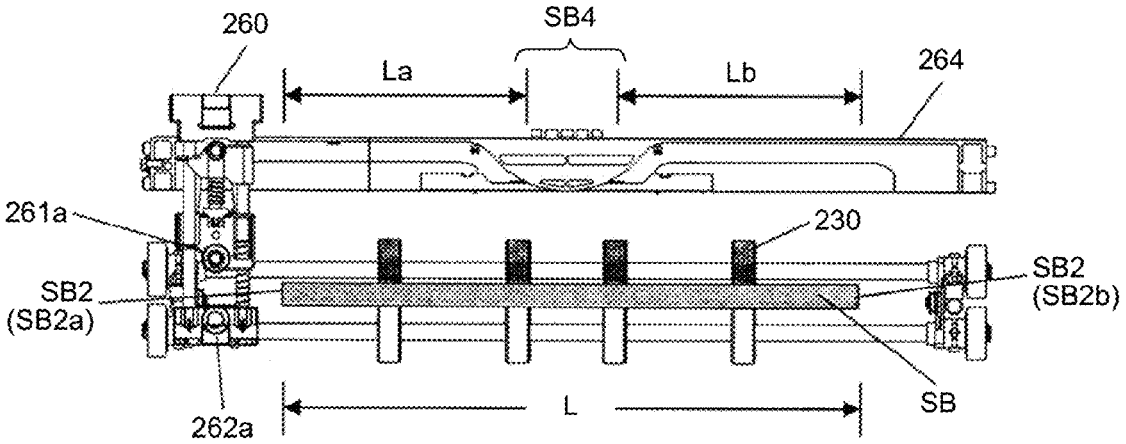
FIG. 12 is an explanatory diagram illustrating an initial state of the additional folding roller unit when the additional folding roller unit performs an additional folding operation.

FIG. 12 illustrates a state where a sheet bundle SB folded by the pair of folding rollers 230 has been conveyed and stops at a preset additional folding position, and the additional folding roller unit 260 is in the waiting position. This state is an initial position of the additional folding operation.

Figure 13:
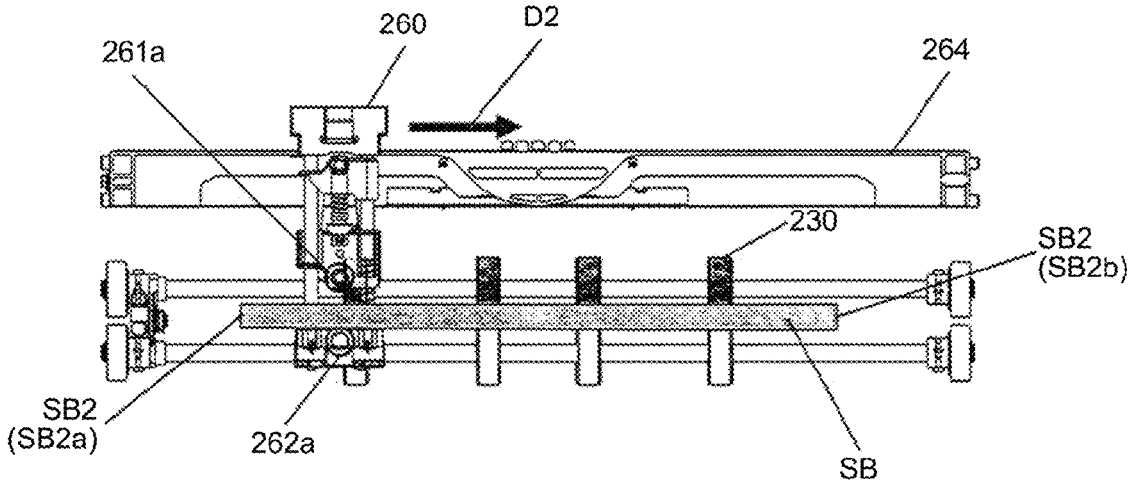
FIG. 13 is an explanatory diagram illustrating a state of the additional folding roller unit at the time of start of forward movement.
Figure 14:
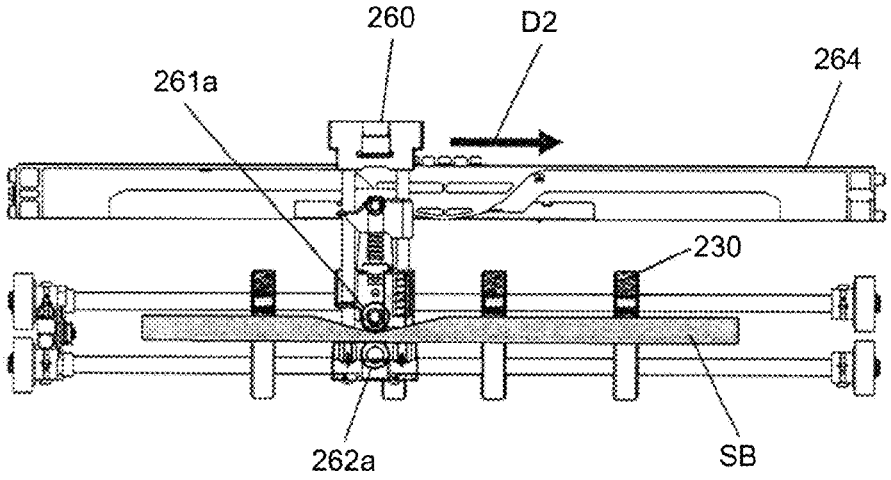
FIG. 14 is an explanatory diagram illustrating a state of the additional folding roller unit when the additional folding roller unit has reached a third guide path near the center of a sheet bundle.

The additional folding roller unit 260 starts moving forward from the initial position (FIG. 12) on the outside of a left-side end (one end) SB2*a* of the sheet bundle SB to the right (in a direction of arrow D2) (FIG. 13). At this time, the pressing mechanism 265 included in the additional folding roller unit 260 moves along the guide path 270 of the guide member 264 by the action of the guide pin 265*a*. Immediately after the start of the operation, the pressing mechanism 265 moves along the first guide path 271. At this time, the pair of additional folding rollers 261*a* and 262*a* is in the pressing cancel state. The pressing cancel state here means a state where the pair of additional folding rollers 261*a* and 262*a* is in contact with the sheet bundle SB but hardly apply pressure to the sheet bundle SB or a state where the pair of additional folding rollers 261*a* and 262*a* is kept away the sheet bundle SB. Incidentally, the pair of additional folding rollers 261*a* and 262*a* is composed of the upper additional folding roller 261*a* and the lower additional folding roller 262*a*.

Figure 15:
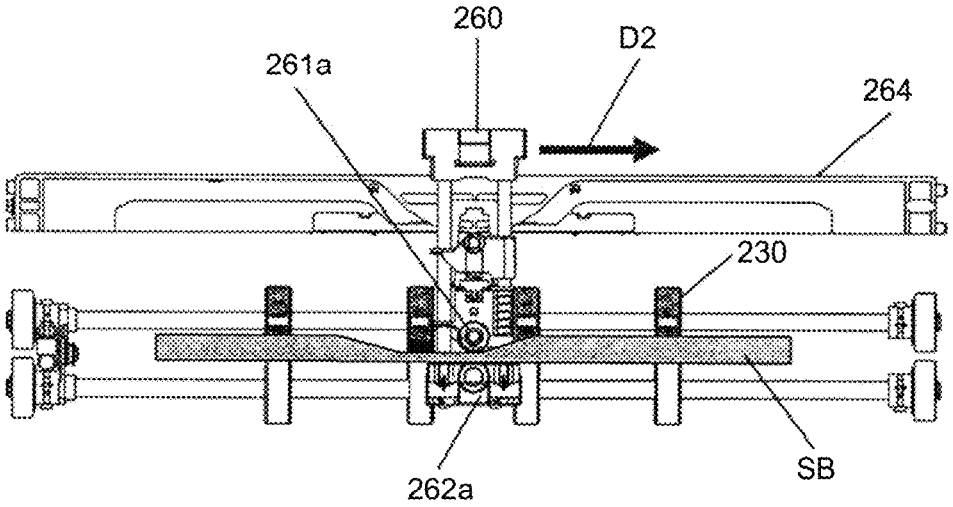
FIG. 15 is an explanatory diagram illustrating a state of the additional folding roller unit when the additional folding roller unit jostles through the first path switching claw and enters a second guide path.

When the pressing mechanism 265 reaches the third guide path 273 near the center SB3 of the sheet bundle SB (FIG. 14), the pressing mechanism 265 starts going down along the third guide path 273, and jostles through the first path switching claw 277 and enters the second guide path 272 (FIG. 15). At this time, the pressing mechanism 265 presses the upper additional folding roller unit 261, and the upper additional folding roller unit 261 comes in contact with the sheet bundle SB and presses the sheet bundle SB.

Figure 16:
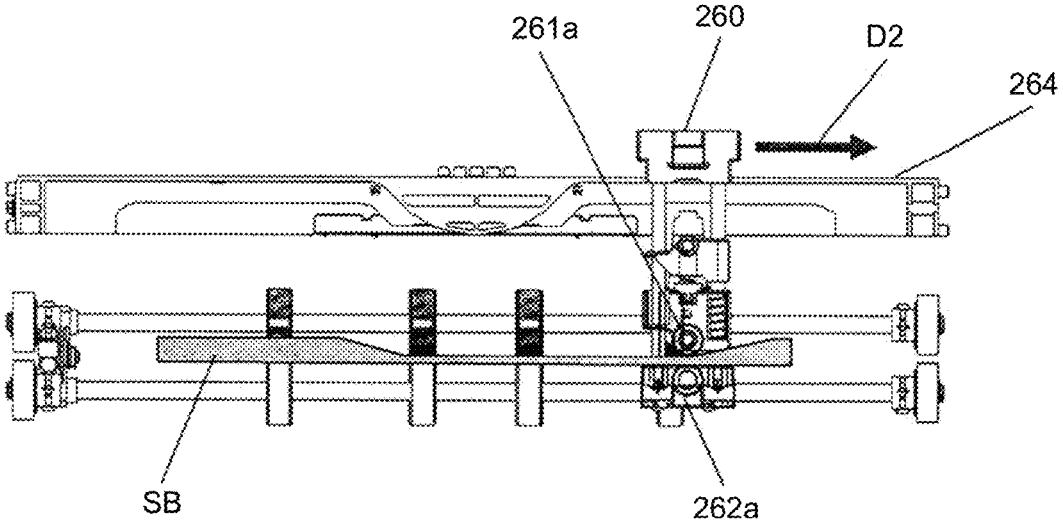
FIG. 16 is an explanatory diagram illustrating a state of the additional folding roller unit when the additional folding roller unit moves to a direction of an end of the sheet bundle while pressing the sheet bundle.
Figure 17:
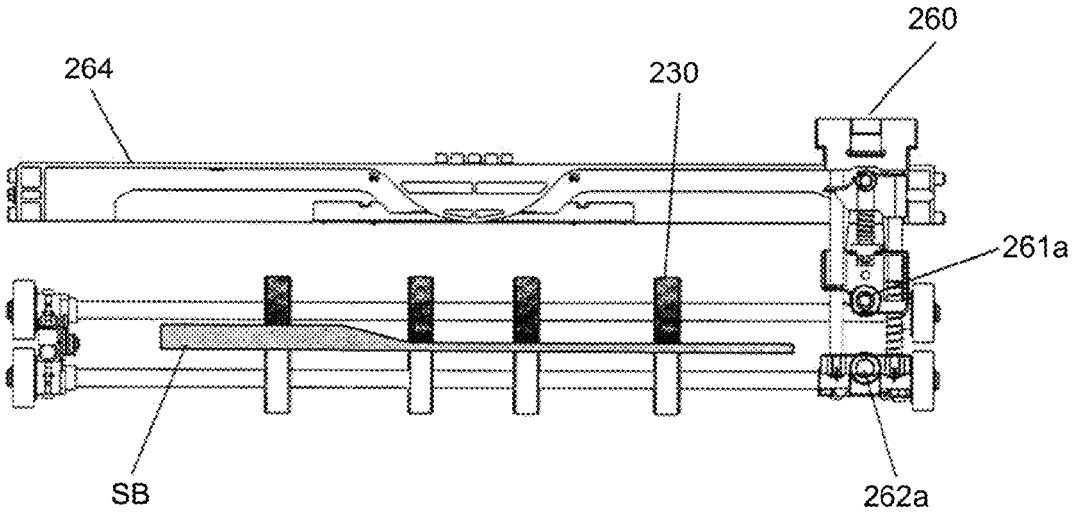
FIG. 17 is an explanatory diagram illustrating a state of the additional folding roller unit when the additional folding roller unit has moved to the final position of the forward movement along the second guide path.

While pressing the sheet bundle SB, the additional folding roller unit 260 further moves in the direction of arrow D2 (FIG. 16). At this time, the second path switching claw 278 cannot move in the opposite direction, and therefore, the pressing mechanism 265 moves along the second guide path 272 without being guided to the sixth guide path 276, and passes through a right-side end (the other end) SB2*b* of the sheet bundle SB, and then is positioned in the final position of the forward movement (FIG. 17). When the pressing mechanism 265 has moved to this position, the guide pin 265*a* of the pressing mechanism 265 moves from the second guide path 272 to the fourth guide path 274 located in the upper part. As a result, restriction on the position the guide pin 265*a* restricted by the top face of the second guide path 272 is released, so the upper additional folding roller 261*a* moves away from the lower additional folding roller 262*a*, and the state goes into the pressing cancel state. Incidentally, here, the end of a sheet bundle SB is denoted by SB2, and, when it is necessary to identify the ends of the sheet bundle SB, one end is denoted by SB2*a*, and the other end is denoted by SB2*b*.

Figure 18:
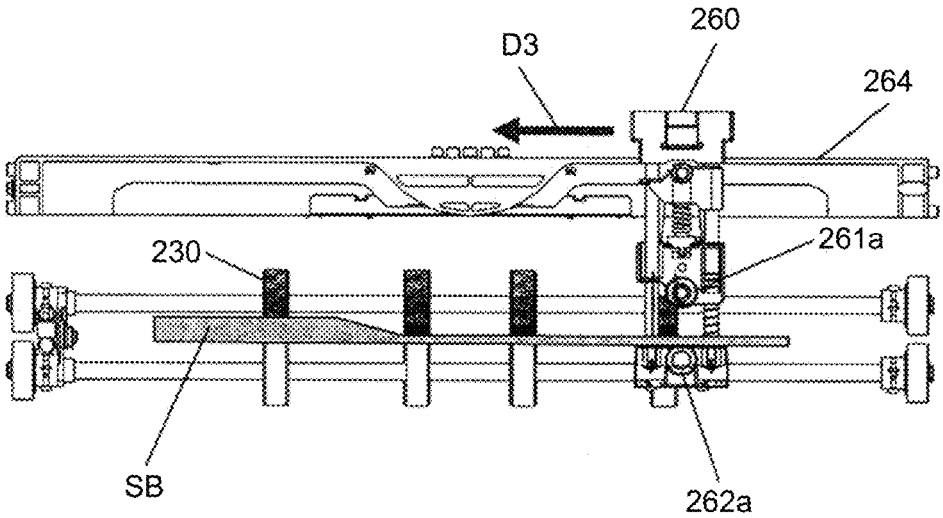
FIG. 18 is an explanatory diagram illustrating a state of the additional folding roller unit when the additional folding roller unit at the time of start of return movement from the final position of the forward movement.
Figure 19:
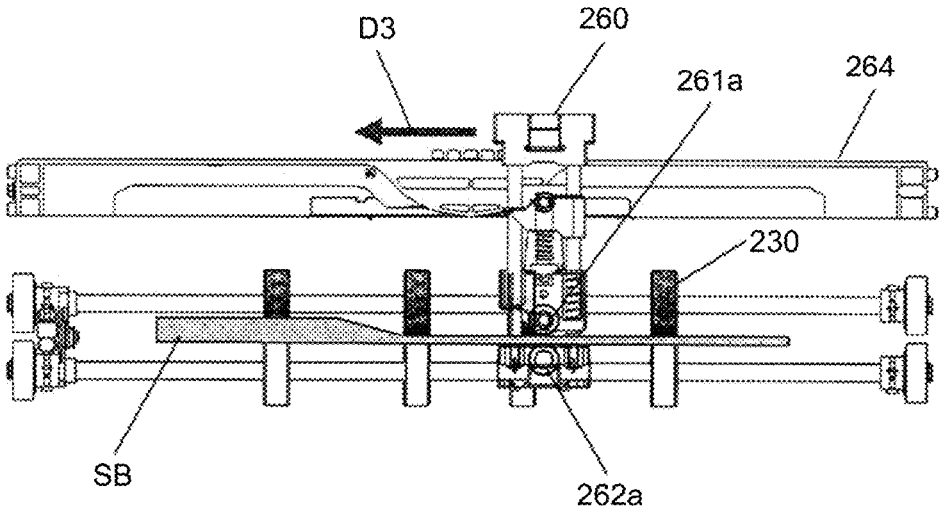
FIG. 19 is an explanatory diagram illustrating a state of the additional folding roller unit when the additional folding roller unit has started the return movement and reaches a sixth guide path.
Figure 20:
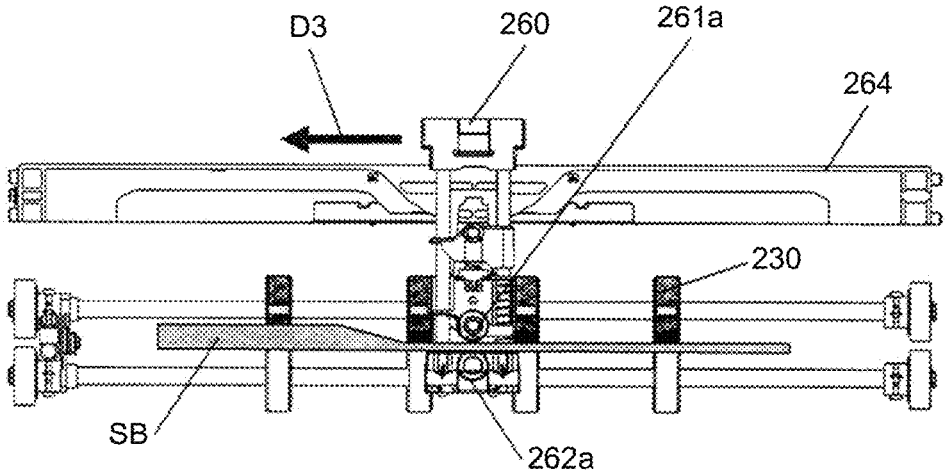
FIG. 20 is an explanatory diagram illustrating a state of the additional folding roller unit when the additional folding roller unit has reached the sixth guide path and shifts from a pressing cancel state to a pressing state.
Figure 21:
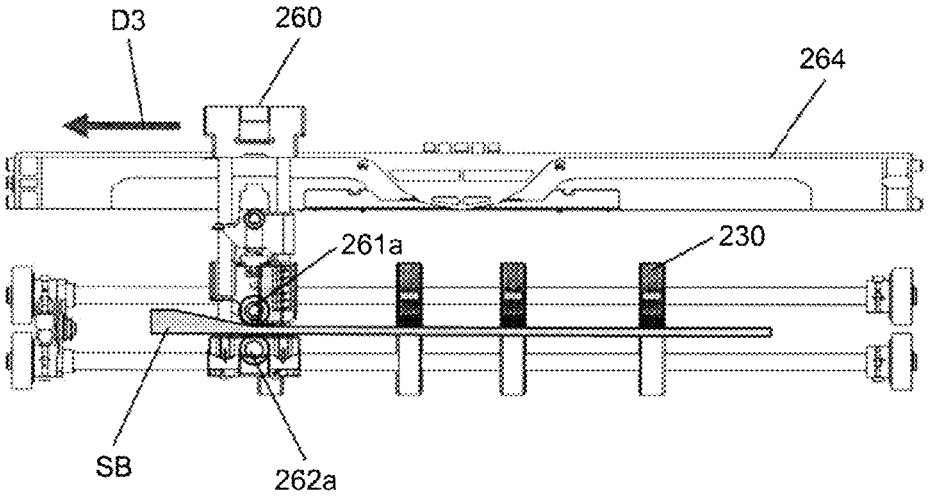
FIG. 21 is an explanatory diagram illustrating a state of the additional folding roller unit when the additional folding roller unit has entered a fifth guide path and goes into the complete pressing state.

Then, the additional folding roller unit 260 is caused to start making return movement by the unit moving mechanism 263 (FIG. 18). In the return movement, the pressing mechanism 265 moves to the left (in a direction of arrow D3) along the fourth guide path 274. When the pressing mechanism 265 reaches the sixth guide path 276 (FIG. 19) in accordance with the movement, the guide pin 265*a* is pushed downward along the shape of the sixth guide path 276, and the pressing mechanism 265 shifts from the pressing cancel state to the pressing state (FIG. 20).

Figure 22:
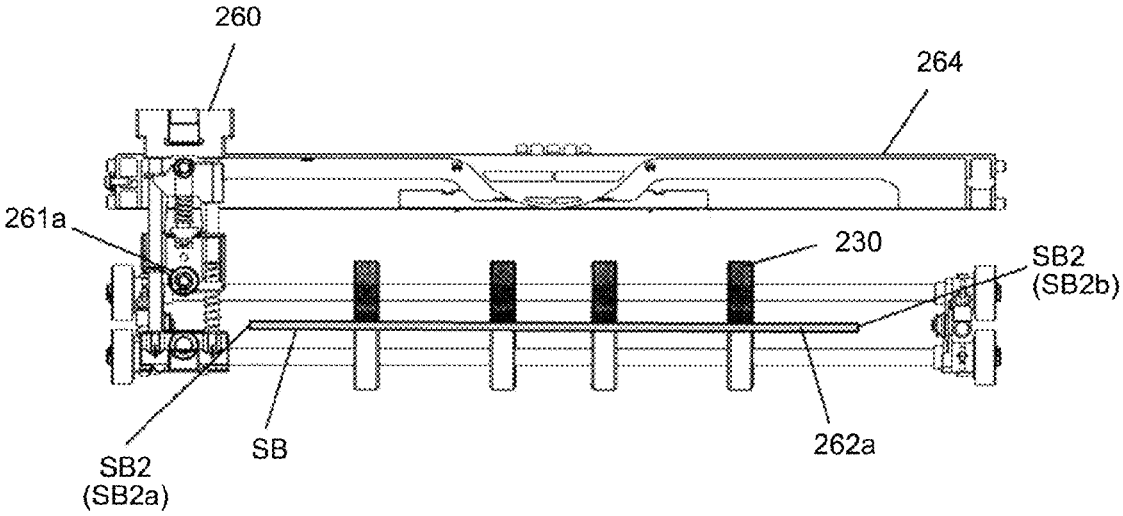
FIG. 22 is an explanatory diagram illustrating a state of the additional folding roller unit when the additional folding roller unit moves backward to the initial position through the fifth guide path.

Then, when the pressing mechanism 265 enters the fifth guide path 275, the pressing mechanism 265 goes into the complete pressing state, and moves through the fifth guide path 275 in the direction of arrow D3 (FIG. 21), and then passes through the end SB2*a* of the sheet bundle SB (FIG. 22).

Additional folding is performed on the sheet bundle SB by the forward and return movements of the additional folding roller unit 260 in this way. At this time, the additional folding is performed by the movements of the additional folding roller unit 260 as follows. The additional folding roller unit 260 starts the additional folding from near the center SB3 to the side of the other end SB2*b* of the sheet bundle SB, and passes through the other end SB2*b* of the sheet bundle SB. After that, the additional folding roller unit 260 starts moving from the outside of the other end SB2*b* and passes over the additionally-folded sheet bundle SB, and starts the additional folding from near the center SB3 to the side of the end SB2*a* of the sheet bundle SB, and passes through the end SB2*a*.

Through these movements, when the additional folding roller unit 260 starts moving from the side of the end SB2*a* to start the additional folding or when the additional folding roller unit 260 returns back to the side of the end SB2*a* after having gone through the other end SB2*b*, the pair of additional folding rollers 261*a* and 262*a* never have contact with the end SB2 of the sheet bundle SB from the outside of the sheet bundle SB, and never applies pressure to the sheet bundle SB. Namely, when the additional folding roller unit 260 passes through the end SB2 of the sheet bundle SB from the outside of the end SB2, the additional folding roller unit 260 is in the pressing cancel state. Therefore, there is no damage to the end SB2 of the sheet bundle SB. Furthermore, the additional folding is performed from near the center SB3 to the end SB2 of the sheet bundle SB; therefore, it is possible to shorten the travel distance of the additional folding roller unit 260 in the additional folding while having the pair of additional folding rollers 261*a* and 262*a* in contact with the sheet bundle SB, and thus the sheet bundle SB is less likely to accumulate twisting which may cause a wrinkle or the like. Therefore, when the fold (spine) SB1 in the sheet bundle SB is additionally-folded, there is no damage to the end SB2 of the sheet bundle SB, and it is possible to suppress the occurrence of curling or a wrinkle in the fold SB1 and its vicinity due to the accumulation of twisting.

To prevent the pair of additional folding rollers 261*a* and 262*a* from running on the end SB2 from the outside of the end SB2 of the sheet bundle SB, the additional folding roller unit 260 is moved as can be seen from FIGS. 12 to 22. Namely, when a distance that the additional folding roller unit 260 in the pressing cancel state moves on the sheet bundle SB in the forward movement (a distance from the end SB2*a*) is denoted by La, and a distance that the additional folding roller unit 260 in the pressing cancel state moves on the sheet bundle SB in the return movement (a distance from the other end SB2*b*) is denoted by Lb, a relationship between the length L of the sheet bundle in the width direction and the distances La and Lb has to meet "L>La+Lb" (FIGS. 12 to 14, FIGS. 17 to 19).

At this time, the distances La and Lb can be set to about the same distance so that the pressing is started, for example, from near the center SB3 of the sheet bundle SB in the width direction (FIGS. 16 and 20).

Incidentally, in the additional folding roller unit 260 according to the present embodiment, the lower additional folding roller unit 262 is provided, and the pair of additional folding rollers 261*a* and 262*a* performs additional folding; alternatively, the lower additional folding roller unit 262 can be eliminated, and the additional folding roller unit 260 can be configured to include the upper additional folding roller unit 261 and a supporting member (not illustrated) having a contact surface opposed to the upper additional folding roller unit 261 and to press a sheet bundle between the upper additional folding roller unit 261 and the supporting member.

Furthermore, in the additional folding roller unit 260 according to the present embodiment, the upper additional folding roller unit 261 is configured to be movable in the vertical direction, and the lower additional folding roller unit 262 is configured to be immovable in the vertical direction; however, the lower additional folding roller unit 262 can be also configured to be movable in the vertical direction. When the lower additional folding roller unit 262 is configured to be movable in the vertical direction, the additional folding rollers 261*a* and 262*a* move away from each other to be symmetrical to the additional folding position; therefore, the additional folding position is fixed regardless of the thickness of a sheet bundle SB, and it is possible to further suppress damage, such as an abrasion.

Incidentally, in the example illustrated in FIGS. 12 to 22, the distances La and Lb are set to about the same distance, and the pressing is started from near the center SB3 of the sheet bundle SB in the width direction (FIGS. 15 and 20). However, it is also possible to set the pressing to start from an arbitrary position of the sheet bundle SB in the width direction, for example, from the inside of near the end SB2. Even if the pressing is started from the inside of near the end SB2, when the pressing is started with the distances La and Lb set to about the same distance, guide members can be formed into a symmetrical shape. As a result, it is possible to reduce the manufacturing cost.

By setting the pressing cancel state and the pressing state in this way, each of the ends SB2*a* and SB2*b* is pressed from the inside of the sheet bundle SB, and the pair of additional folding rollers 261*a* and 262*a* never come in direct contact with from the corner side of the ends SB2*a* and SB2*b*. Incidentally, a mechanism in the case of additional folding set in this way is identical to that illustrated in FIGS. 9, 10, and 11, and only differs in the setting of the distances La and Lb.

Figure 23:
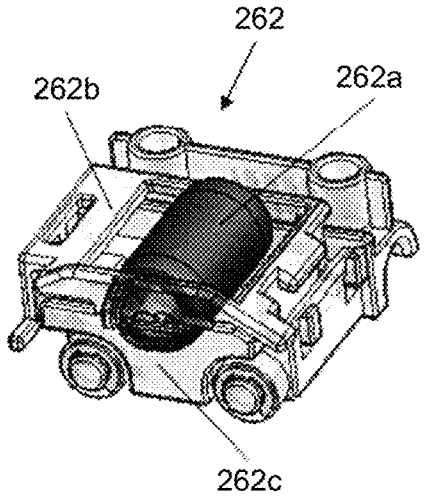
FIG. 23 is a diagram illustrating a configuration of the additional folding unit.
Figure 24:
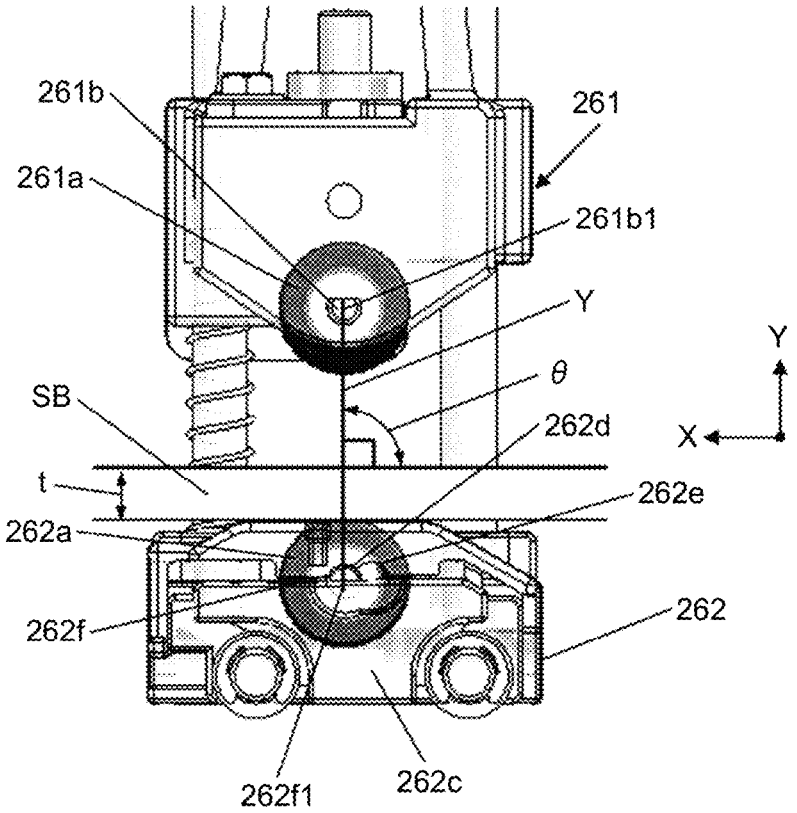
FIG. 24 is a diagram illustrating a traveling direction of the additional folding unit and a positional relationship between upper and lower additional folding rollers corresponding to a first position.
Figure 25:
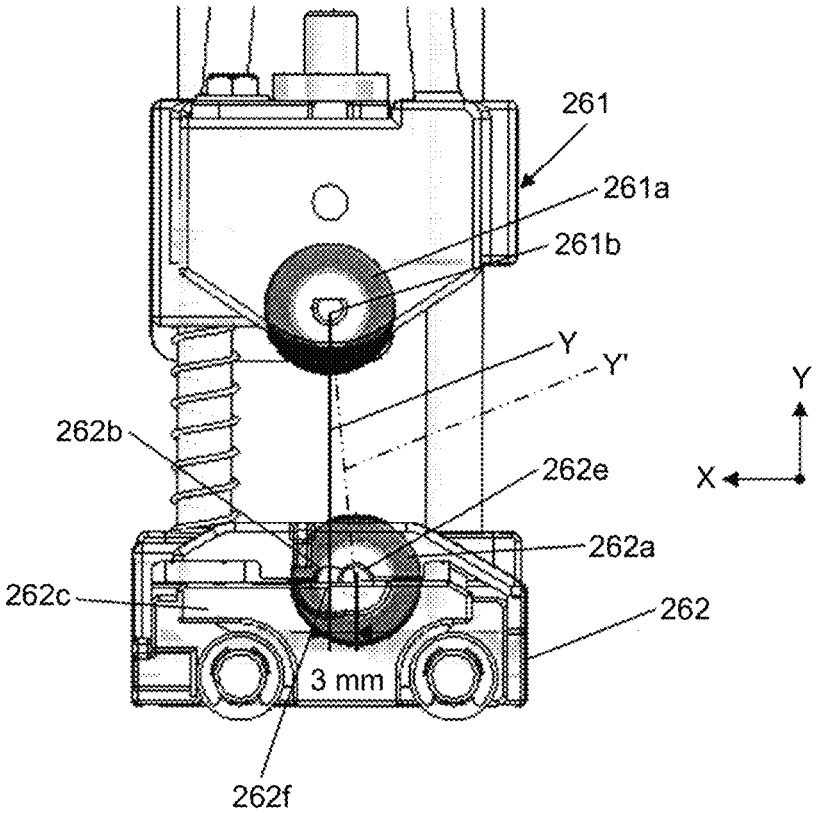
FIG. 25 is a diagram illustrating the traveling direction of the additional folding unit and a positional relationship between the upper and lower additional folding rollers corresponding to a second position.
Figure 26:
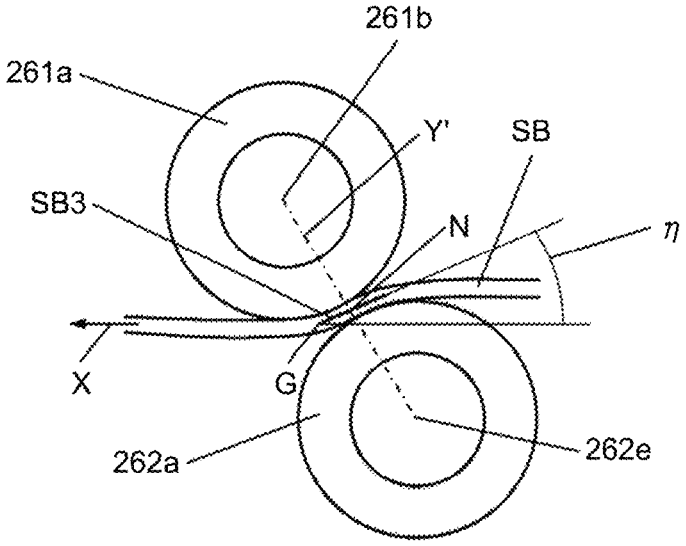
FIG. 26 is a diagram illustrating a state where a staple and the pair of additional folding rollers at the time of additional folding are in the first position, and the staple is located on the center of a sheet bundle.

FIG. 23 is a diagram for explaining a configuration of the additional folding unit 260, and FIGS. 24 and 25 are diagrams illustrating a traveling direction of the additional folding unit 260 and a positional relationship between the pair of upper and lower additional folding rollers 261*a* and 262*a*. The lower additional folding roller unit 262 is composed of the lower additional folding roller 262*a*, a cover 262*b*, and a lower additional folding roller case 262*c* as illustrated in FIG. 23. The lower additional folding roller 262*a* is rotatably supported by the lower additional folding roller case 262*c*.

As illustrated in FIGS. 24 and 25, two bearings are installed in the lower additional folding roller case 262*c*. The two bearings are a first bearing 262*d* and a second bearing 262*e*. The first bearing 262*d* is installed in such a position that an angle θ between a straight line Y connecting a center 261*b*1 of a rotating shaft 261*b* of the upper additional folding roller 261*a* and a center 262*f*1 of a rotating shaft 262*f* of the lower additional folding roller 262*a* and the traveling direction of the additional folding unit 260 (which is equal to the width direction of a sheet bundle SB) is 90°. FIG. 24 is a diagram illustrating this state. This traveling direction of the additional folding unit 260 corresponds to a tangential direction G of a nip N between the pair of additional folding rollers 261*a* and 262*a*.

Incidentally, the direction of the straight line Y connecting the center 261*b*1 of the rotating shaft 261*b* of the upper additional folding roller 261*a* and the center 262*f*1 of the rotating shaft 262*f* of the lower additional folding roller 262*a* is parallel to a thickness direction t of a sheet bundle SB. FIG. 24 illustrates an initial state before pressing a sheet bundle SB is started, and the position where the upper additional folding roller 261*a* comes down and holds the sheet bundle SB between the upper and lower additional folding rollers 261*a* and 262*a* is a first position.

As illustrated in FIG. 25, the second bearing 262*e* is installed 3 millimeters from the position of the first bearing 262*d* illustrated in FIG. 24 on the upstream side of the first bearing 262*d* in the forward movement direction. Accordingly, when the lower additional folding roller 262*a* is moved to the second bearing 262*f*, a straight line Y' connecting respective centers of the rotating shafts 261*b* and 262*f* of the upper and lower additional folding rollers 261*a* and 262*a* is inclined from the straight line Y of when the lower additional folding roller 262*a* is located in the first bearing 262*d*.

FIGS. 26 to 29 are diagrams illustrating a relationship between a staple and the pair of additional folding rollers 261*a* and 262*a* in additional folding. As can be seen from FIG. 26, when the pair of additional folding rollers 261*a* and 262 holds a sheet bundle SB in the nip N between them to enhance a fold in the sheet bundle SB, the straight line Y' is inclined at an angle η to a width direction X of the sheet bundle SB. Accordingly, a pressing force is applied to a fold SB1 in the sheet bundle SB in a state where the fold SB1 is tilted to the width direction X (or the traveling direction of the additional folding unit 260). As a result, the fold can be enhanced as compared with the case illustrated in FIG. 24. Incidentally, the tilt corresponds to the inclination η in the tangential direction G of the nip N between the pair of additional folding rollers 261*a* and 262*a*. This position is a second position.

Figure 27:
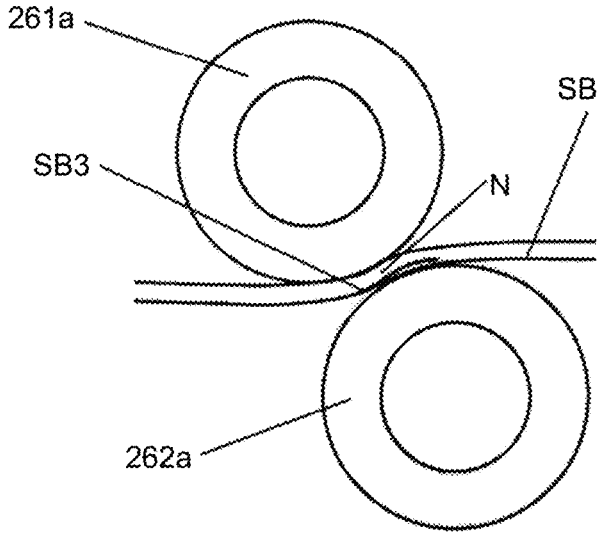
FIG. 27 is a diagram illustrating a state where the staple and the pair of additional folding rollers at the time of additional folding are in the first position, and the staple on the sheet bundle is located on the side of the lower additional folding roller.
Figure 28:
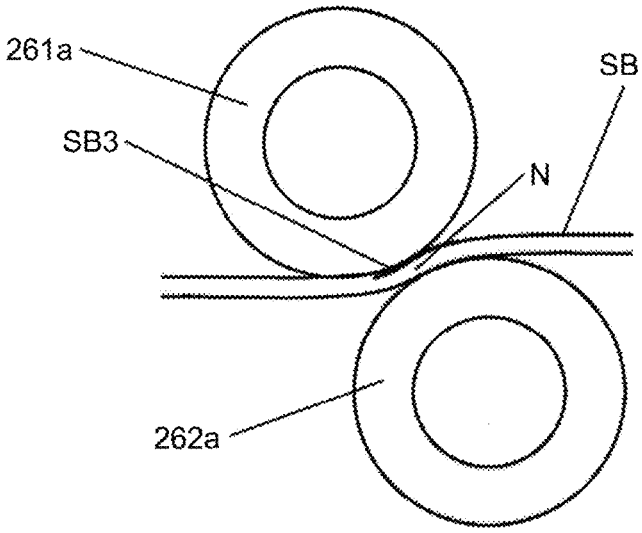
FIG. 28 is a diagram illustrating a state where the staple and the pair of additional folding rollers at the time of additional folding are in the first position, and the staple on the sheet bundle is located on the side of the upper additional folding roller.

At this second position, when a staple SB3 is located at the position in contact with the lower additional folding roller 262*a* as illustrated in FIG. 27 or the position in contact with the upper additional folding roller 261*a* as illustrated in FIG. 28, the staple SB3 is likely to be deformed. This is because a force from the lower additional folding roller 262*a* or the upper additional folding roller 261*a* is directly applied to the staple SB3. When the staple SB3 is deformed in this way, a portion of the fold SB1 bound by the staple SB3 in the sheet bundle SB is deformed, and the folding quality deteriorates.

Figure 29:
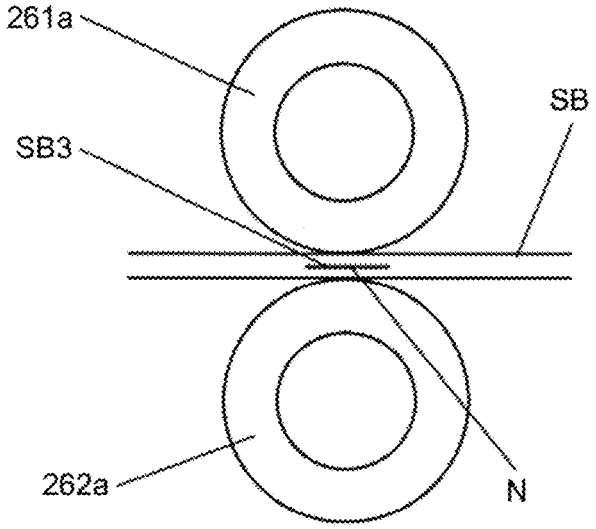
FIG. 29 is a diagram illustrating a state where the staple and the pair of additional folding rollers at the time of additional folding are in the second position, and the staple is located on the center of the sheet bundle.

Therefore, when the folding quality is a problem, the position of the lower additional folding roller 262*a* is changed to the first bearing 262*d* at which the angle θ becomes 90° as illustrated in FIG. 24. This position is the first position. Consequently, a force causing the staple SB3 to be bent is never applied to the staple SB3 as illustrated in FIG. 29, so the portion of the fold SB1 bound by the staple SB3 in the sheet bundle SB is never deformed. Therefore, it is possible to guarantee high-quality folding.

Incidentally, in the present embodiment, two bearings are installed in the lower additional folding roller case 262*c*; however, the number of bearings can be three or more, and the additional one or more bearings can be installed on the side of the upper additional folding roller unit 261. Furthermore, in the present embodiment, the second bearing 262*e* is installed 3 millimeters from the position of the first bearing 262*d* on the upstream side of the first bearing 262*d* in the forward movement direction; however, the second bearing 262*e* can be installed on the downstream side of the first bearing 262*d*.

Figure 30:
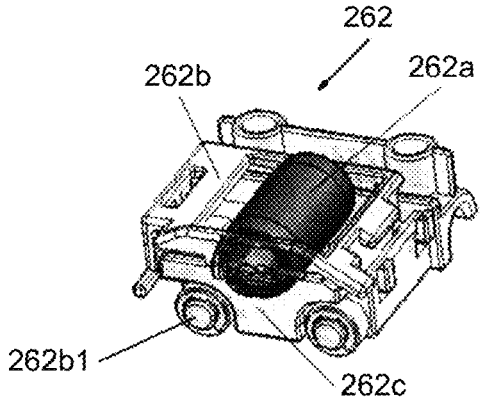
FIG. 30 schematically illustrates an example where a user moves the lower additional folding roller.
Figure 30:
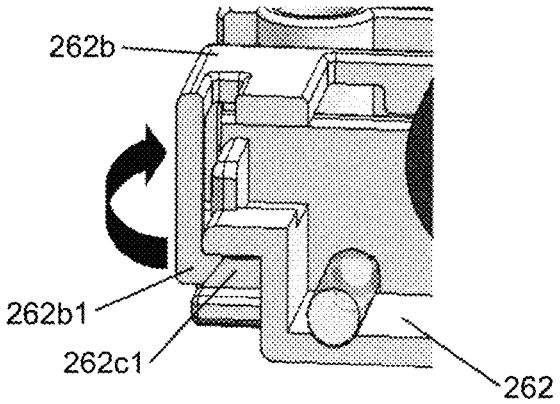
Figure 30:
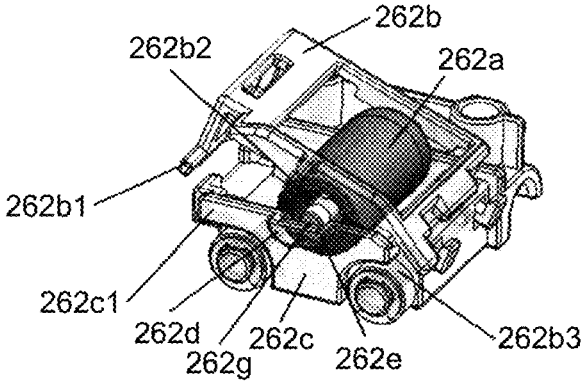
Figure 30:
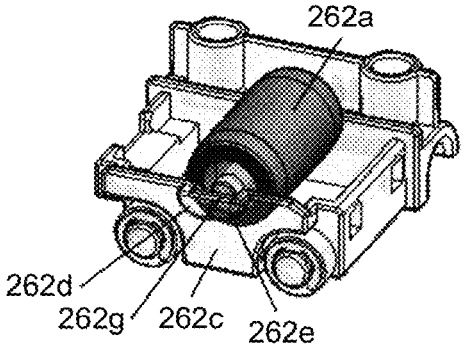

FIG. 30 illustrates how to move the lower additional folding roller 262*a*.

In FIG. 30, (a) illustrates an initial state, and is identical to FIG. 23. In this state, the lower additional folding roller 262*a* is attached to the first bearing 262*d*. As illustrated in (b) of FIG. 30, in the cover 262*b*, an engagement piece 262*b*1 which is engaged with the lower additional folding roller case 262*c* to elastically join the cover 262*b* and the lower additional folding roller case 262*c* is installed on the outside of the cover 262*b*. In FIG. 30, (b) illustrates a state where the engagement piece 262*b*1 is engaged with the lower additional folding roller case 262*c*, and the cover 262*b* is locked by the lower additional folding roller case 262*c*, thereby the lower additional folding roller 262*a* is rotatably held by the first bearing 262*d*.

From this state, the elastic engagement state of the engagement piece 262*b*1 with the lower additional folding roller case 262*c* is released by operating the engagement piece 262*b*1 as indicated by an arrow illustrated in (b) of FIG. 30. Accordingly, the cover 262*b* is opened as illustrated in (c) of FIG. 30, and a shaft 262*g* of the lower additional folding roller 262*a* can be moved from the first bearing 262*d* to the second bearing 262*e*. The cover 262*b* enables the elastic engagement, so the cover 262*b* is made of material having elasticity, such as polyoxymethylene (POM), by casting.

Incidentally, (c) and (d) of FIG. 30 illustrate a state after the lower additional folding roller 262*a* has been moved to the second bearing 262*e*.

The first and second bearings 262*d* and 262*e* are paired up with bearings 262*b*1 and 262*b*2 on the side of the cover 262*b*, respectively. When the cover 262*b* is opened, the first and second bearings 262*d* and 262*e* are also opened.

Figure 31:
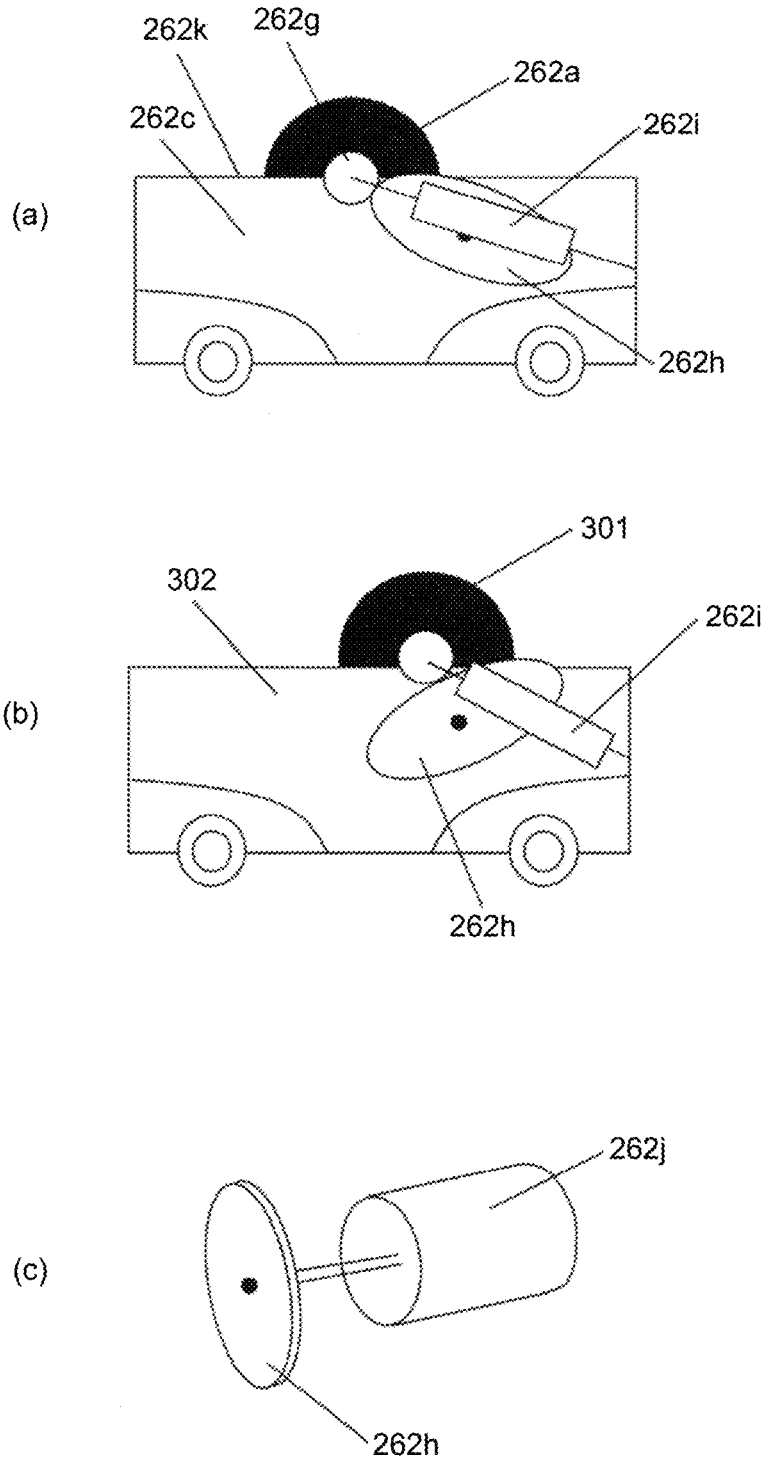
FIG. 31 schematically illustrates an example where the lower additional folding roller is moved by using a cam.

FIG. 30 illustrates an example of a configuration requiring direct user operation; however, the bearing position can be mechanically changed. FIG. 31 schematically illustrates an example of changing the position of the lower additional folding roller 262*a* by using a cam.

In this example, the shaft 262*g* of the lower additional folding roller 262*a* serves as a cam follower, and is moved by an eccentric cam 262*h*. Specifically, as illustrated in FIG. 31, the shaft 262*g* is pressed against the cam face of the eccentric cam 262*h* by a tension spring 262*i*, thereby the shaft position is controlled. On the other hand, the eccentric cam 262*h* is driven to rotate by a motor 262*j* as illustrated in (c) of FIG. 31. Then, in accordance with the rotational position of the eccentric cam 262*h*, the lower additional folding roller 262*a* linearly reciprocates along a guide surface 262*k* of the lower additional folding roller case 262*c*. Accordingly, the relative position of the lower additional folding roller 262*a* with respect to the upper additional folding roller 261*a* can be arbitrarily changed within a range in which the lower additional folding roller 262*a* can make reciprocating movement.

In FIG. 31, the position of the lower additional folding roller 262*a* illustrated in (a) of FIG. 31 corresponds to that illustrated in FIG. 24, and the position of the lower additional folding roller 262*a* illustrated in (b) of FIG. 31 corresponds to that illustrated in FIG. 25.

Incidentally, the motor 262*j* is controlled by the CPU 200*a* of the control circuit 200 mounted on the saddle-stitch bookbinding apparatus 2 on the basis of, for example, operation input from a control panel (not illustrated) installed on the side of the image forming apparatus PR. The CPU 200*a* includes a control unit and an operation unit; the control unit controls the flow of command interpretation and program control, and the operation unit carries out an operation. A program is stored in a memory (not illustrated), and a command (a numerical value or a sequence of numerical values) to be executed is fetched from the memory storing therein the program, and the program is executed.

Furthermore, a solenoid can be used instead of the eccentric cam 262*h* and the motor 262*j*. However, if it is driven by a solenoid, the lower additional folding roller 262*a* can take only two positions corresponding to the positions illustrated in FIGS. 24 and 25 as is the case illustrated in FIG. 30.

Figure 32:
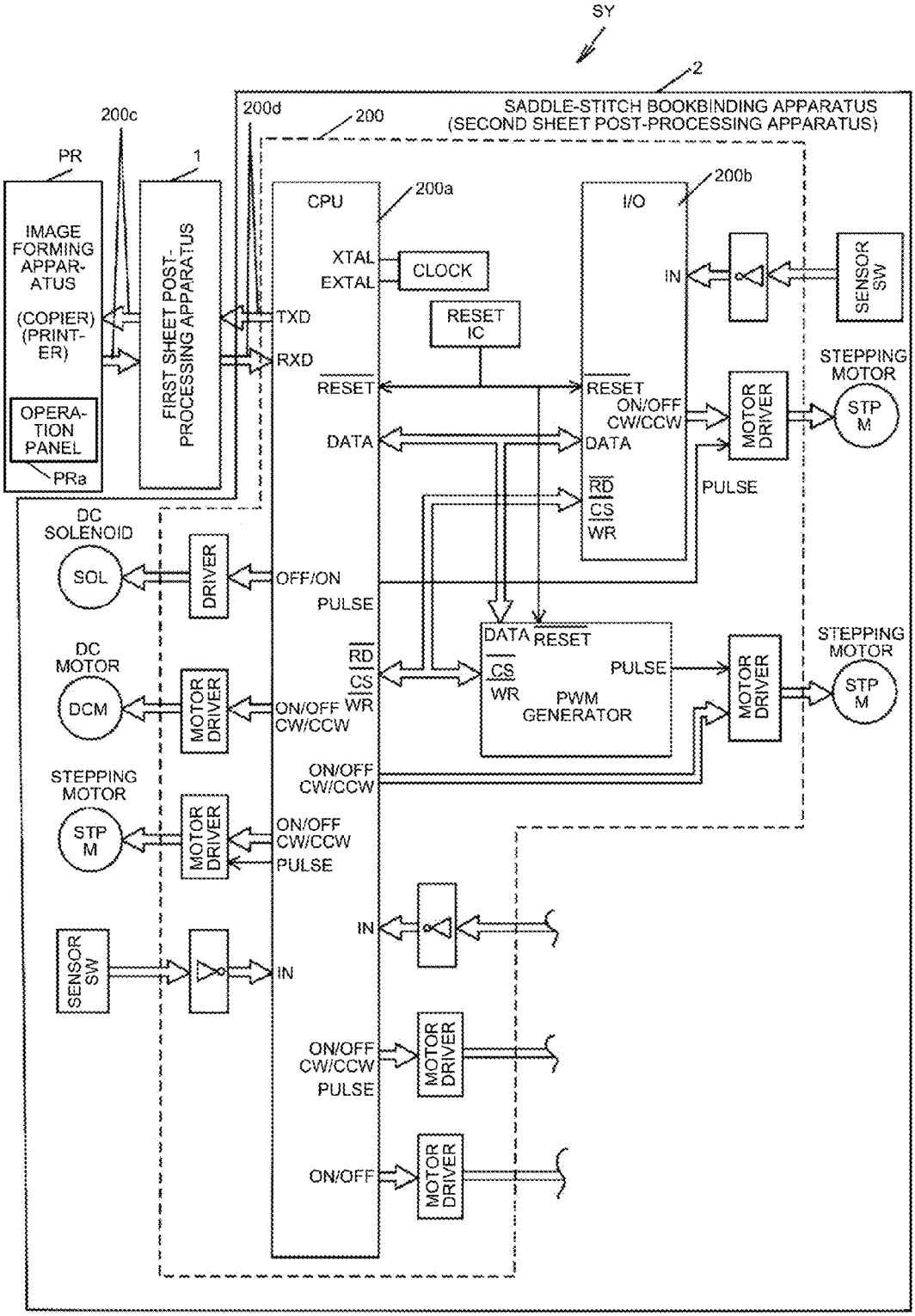
FIG. 32 is a block diagram illustrating a control configuration of an image forming system composed of the image forming apparatus and multiple sheet processing apparatuses according to the embodiment of the present invention.

FIG. 32 is a block diagram illustrating a control configuration of the image forming system SY composed of the image forming apparatus PR and the sheet processing apparatuses 1 and 2 according to the present embodiment. The image forming apparatus PR, the first sheet post-processing apparatus 1, and the saddle-stitch bookbinding apparatus 2 are connected in series by first and second communication interfaces 200*c* and 200*d*, respectively, can communicate between them. The entire saddle-stitch bookbinding apparatus 2 and units included in the saddle-stitch bookbinding apparatus 2 are controlled by the control circuit 200 of the saddle-stitch bookbinding apparatus 2.

The saddle-stitch bookbinding apparatus 2 includes the control circuit 200 equipped with a microcomputer including the CPU 200*a* and an I/O interface 200*b*, etc. Signals from a CPU or switches of an operation panel PRa, etc. of the image forming apparatus PR and sensors (not illustrated) are input to the CPU 200*a* via the first communication interface 200*c*, the first sheet post-processing apparatus 1, and the second communication interface 200*d*. In the control circuit 200 of the saddle-stitch bookbinding apparatus 2, the CPU 200*a* performs prescribed control on the basis of an input signal.

Namely, the control of the saddle-stitch bookbinding apparatus 2 is performed on the basis of an instruction or information from the CPU of the image forming apparatus PR. A user issues an operation instruction through the operation panel PRa of the image forming apparatus PR. Incidentally, if the saddle-stitch bookbinding apparatus 2 is provided with an operation panel, a user can issue an operation instruction through this operation panel.

Accordingly, an operation signal through the operation panel PRa is transmitted from the image forming apparatus PR to the saddle-stitch bookbinding apparatus 2, and a processing state and functions of the saddle-stitch bookbinding apparatus 2 are notified to the user through the operation panel PRa.

Furthermore, the CPU 200*a* performs drive control of the solenoid and the motor via a driver and a motor driver, and acquires sensor information stored in the apparatus from an interface. Moreover, depending on a controlled object or a sensor, the CPU 200*a* controls the motor driver so as to drive the motor via the I/O interface 200*b*, and acquires sensor information from the sensor.

Just like the saddle-stitch bookbinding apparatus 2, the first sheet post-processing apparatus 1 also includes a control circuit equipped with a microcomputer including a CPU and an I/O interface, etc., and performs control corresponding to the sheet-bundle making function.

FIGS. 33 to 36 are flowcharts illustrating control procedures for setting the additional folding intensity of the saddle-stitch bookbinding apparatus 2 according to the present embodiment. Incidentally, these control procedures are executed by the CPU 200*a* of the saddle-stitch bookbinding apparatus 2, and an agent of the control and setting is the CPU 200*a*.

Figure 33:
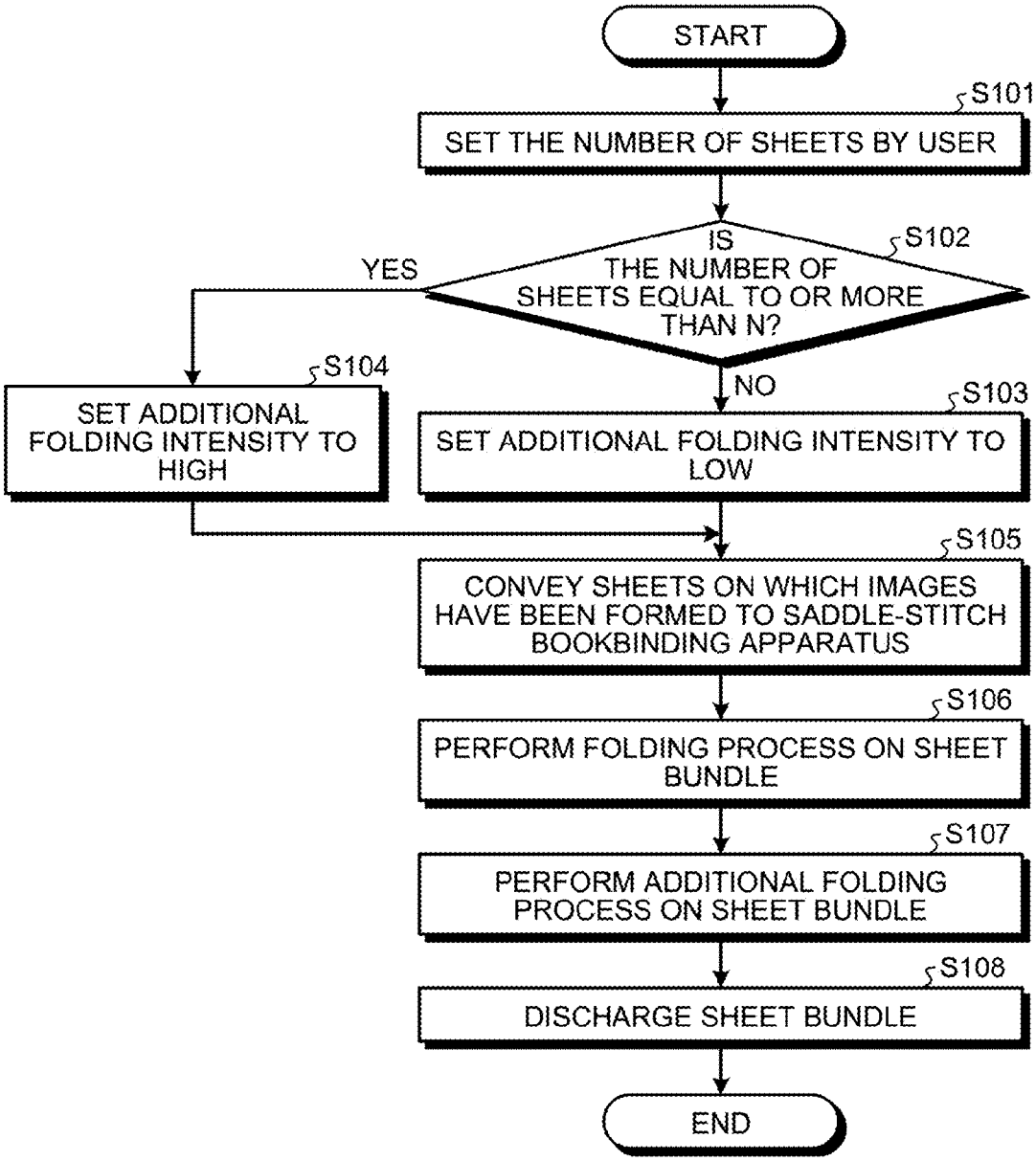
FIG. 33 is a flowchart illustrating a control procedure for setting the additional folding level on the basis of information on the number of sheets set through an operation panel by a user.

FIG. 33 is a flowchart illustrating a control procedure for setting the additional folding level (the additional folding intensity) on the basis of information on the number of sheets set through the operation panel PRa by a user.

In this control procedure, first, the user inputs the number of sheets to be additionally-folded through the operation panel PRa. Accordingly, sheet-number setting is performed (Step S101). The CPU 200*a* determines whether the number of sheets set by the user is equal to or more than a preset sheet number N (Step S102). When the number of sheets is equal to or more than N (YES at Step S102), the CPU 200*a* sets the additional folding intensity to "high" (Step S104). Accordingly, as explained above with reference to FIG. 31, the eccentric cam 262*h* of the additional folding roller unit 260 is rotated by the motor 262*j*, thereby changing (increasing) the angle η illustrated in FIG. 26, so that additional folding can be performed at "high" level.

On the other hand, when the number of sheets is less than N (NO at Step S102), the CPU 200*a* sets the additional folding intensity to "low" (Step S103). Accordingly, as explained above with reference to FIG. 31, the eccentric cam 262*h* of the additional folding roller unit 260 is rotated by the motor 262*j*, thereby changing (decreasing) the angle η illustrated in FIG. 26, so that additional folding can be performed at "low" level.

Incidentally, to simplify the explanation, the additional folding intensity is set to either one of the two levels, i.e., either "low" or "high" at Step S103 or S104; however, three or more levels of additional folding intensity can be set in a stepwise or continuous fashion according to information on the number of sheets. Furthermore, when the additional folding intensity is set to "low", it is possible to set $\eta=0$ ($\theta=90°$). When the additional folding intensity is set in a stepwise or continuous fashion, the CPU 200*a* just has to control a rotation angle of the motor 262*j*. To set the additional folding intensity appropriately or optimally, it is necessary to enable the CPU 200*a* to set the intensity in a continuous fashion. For this control, for example, a stepping motor is suitable.

When the additional folding intensity has been set at Step S103 or S104, the image forming apparatus PR performs an image forming operation, and makes a sheet bundle SB corresponding to the number of sheets set in the first sheet post-processing apparatus 1, and then conveys the sheet bundle SB to the saddle-stitch bookbinding apparatus 2 (Step S105). Then, the saddle-stitch bookbinding apparatus 2 performs a folding process on the sheet bundle SB as described in FIGS. 2 to 6 (Step S106), and further performs an additional folding process on the sheet bundle SB as described in FIGS. 12 to 22 (Step S107). After completion of the additional folding process, the saddle-stitch bookbinding apparatus 2 discharges the sheet bundle SB to the outside of the apparatus (Step S108).

Figure 34:
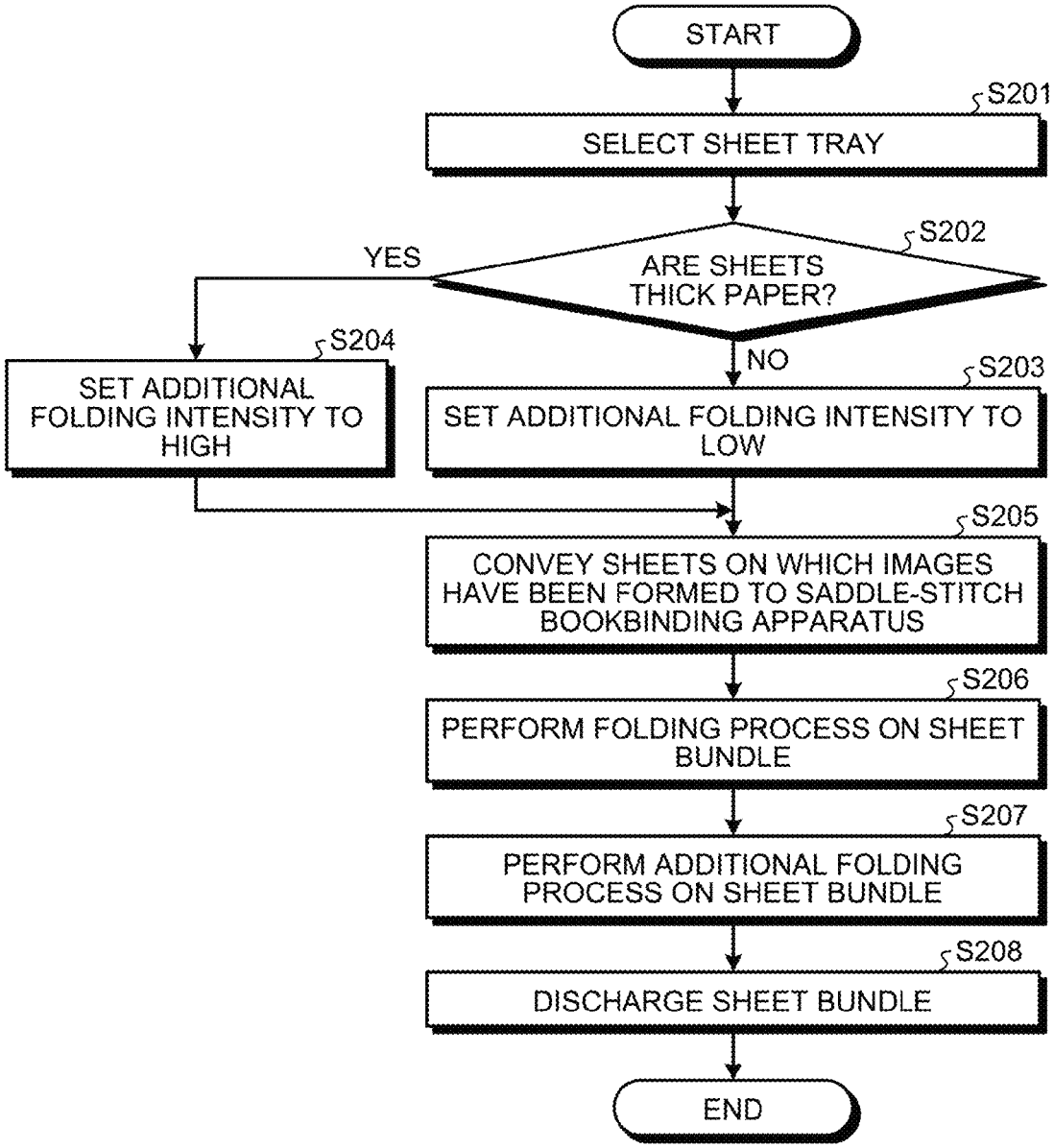
FIG. 34 is a flowchart illustrating a control procedure for setting the additional folding level on the basis of information on the thickness of sheets set on a sheet tray of the image forming apparatus.

FIG. 34 is a flowchart illustrating a control procedure for setting the additional folding level (the additional folding intensity) on the basis of information on the thickness of sheets set on a sheet tray (not illustrated) of the image forming apparatus PR.

For example, when a sheet is thick and set to special paper such as coated paper, the additional folding intensity needs to be high. In this example, the sheet thickness is acquired from sheet information on sheets contained in a sheet tray, and the additional folding intensity is appropriately or optimally controlled on the basis of the information.

In this control procedure, when a sheet tray of the image forming apparatus PR has been selected (Step S201), the CPU 200*a* determines whether the thickness of sheets contained in the sheet tray is larger than a preset reference thickness on the basis of sheet thickness information of the sheets (Step S202). When the thickness of the sheets is larger than the reference thickness (i.e., when the sheets are thick paper) (YES at Step S202), the CPU 200*a* sets the additional folding intensity to "high" (Step S204). On the other hand, when the thickness of the sheets is smaller than the reference thickness (NO at Step S202), the CPU 200*a* sets the additional folding intensity to "low" (Step S203). On the basis of this setting, the eccentric cam 262*h* is rotated by the motor 262*j* of the additional folding roller unit 260, thereby the additional folding roller unit 260 is put into "high" or "low" state.

Then, at Steps S205 to S208, a conveying process, a folding process, an additional folding process, and a discharge process are performed in the same manner as at Steps S105 to S108, and the process is terminated.

Also in this case, to simplify the explanation, the additional folding intensity is set to either one of the two levels, i.e., either "low" or "high"; however, three or more levels of additional folding intensity can be set in a stepwise or continuous fashion according to information on the number of sheets. Furthermore, when the additional folding intensity is set to "low", it is possible to set $\eta=0$ ($\theta=90°$).

Figure 35:
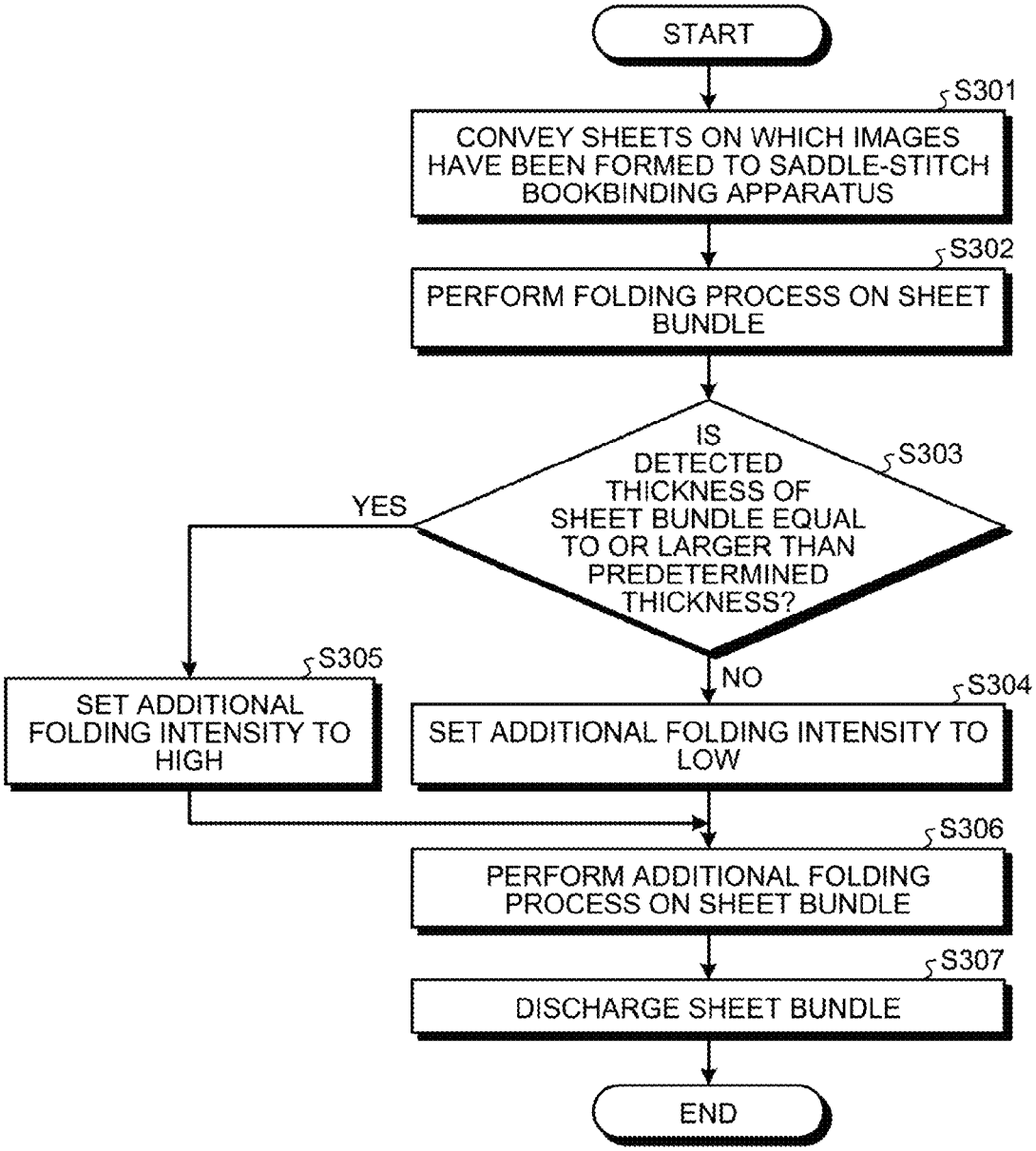
FIG. 35 is a flowchart illustrating a control procedure for detecting the thickness of a sheet bundle to be additionally-folded and setting the additional folding intensity.

FIG. 35 is a flowchart illustrating a control procedure for detecting the thickness of a sheet bundle SB to be additionally-folded and setting the additional folding intensity.

The thickness of a sheet bundle SB will be described later with reference to FIG. 37. A thickness sensor 266 for detecting the thickness of an additional fold SB1 in a sheet bundle SB is installed in the additional folding roller unit 260 to detect the thickness of the fold SB1 in the sheet bundle SB to be additionally-folded or the thickness of the sheet bundle SB on the basis of sensor output of the thickness sensor 266.

In this control procedure, first, upon completion of an image forming operation of the image forming apparatus PR, the first sheet post-processing apparatus 1 makes a bundle SB of sheets corresponding to one saddle-stitched booklet, and conveys the sheet bundle SB to the saddle-stitch bookbinding apparatus 2 (Step S301). Then, the saddle-stitch bookbinding apparatus 2 performs a folding process on the sheet bundle SB as described in FIGS. 2 to 6 (Step S302), and the CPU 200*a* determines whether the thickness of the sheet bundle SB detected by the thickness sensor 266 is equal to or larger than a preset thickness (Step S303). When having determined that the thickness of the sheet bundle SB is equal to or larger than the preset thickness (YES at Step S303), the CPU 200*a* sets the additional folding intensity to "high" (Step S305). On the other hand, when the thickness of the sheet bundle SB is smaller than the preset thickness (NO at Step S303), the CPU 200*a* sets the additional folding intensity to "low" (Step S304). In accordance with this setting, the eccentric cam 262*h* is rotated by the motor 262*j* of the additional folding roller unit 260, thereby the additional folding roller unit 260 is put into "high" or "low" state.

Then, the additional folding process described at Step S107 is performed at Step S306, and the discharge process described at Step S108 is performed at Step S307, and then the process is terminated.

Also in this case, to simplify the explanation, the additional folding intensity is set to either one of the two levels, i.e., either "low" or "high"; however, three or more levels of additional folding intensity can be set in a stepwise or continuous fashion according to information on the number of sheets. Furthermore, when the additional folding intensity is set to "low", it is possible to set $\eta=0$ ($\theta=90°$).

Moreover, in this control procedure, the thickness of a folded sheet bundle SB is detected by the thickness sensor 266 installed in the additional folding roller unit 260; however, the thickness of a before-folded sheet bundle SB can be detected, and then the sheet bundle SB can be processed in the same control procedure.

Figure 36:
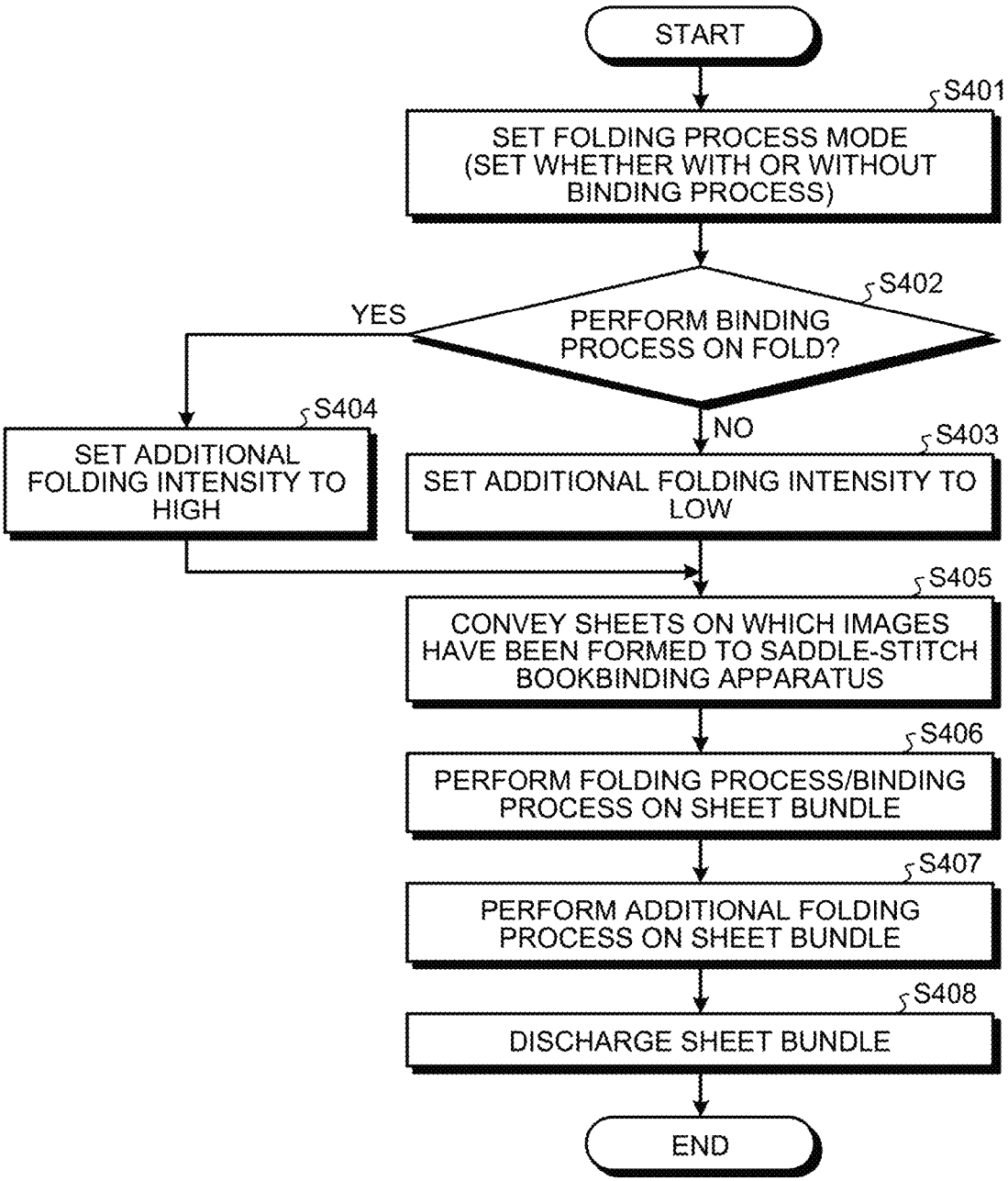
FIG. 36 is a flowchart illustrating a control procedure for setting the additional folding intensity depending on a setting of whether or not to bind a fold with a staple in a folding process.

FIG. 36 is a flowchart illustrating a control procedure for setting the additional folding intensity depending on a setting of whether or not to bind a fold SB1 with a staple SB3 in a folding process.

When a sheet bundle SB is saddle-stitched as described above with reference to FIGS. 27 and 28, the staple SB3 may be deformed. Namely, especially when the staple SB3 is held between the upper and lower additional folding rollers 261*a* and 262*a*, and also the staple SB3 is in contact with the additional folding roller 261*a* or 262*a*, the staple SB3 could be deformed by an additional folding process. Therefore, when a binding process is performed, by setting the additional folding intensity to "low", deformation of the staple SB3 can be suppressed. The flowchart in FIG. 36 illustrates the control procedure to automatically suppress deformation of the staple SB3.

In this control procedure, first, the CPU 200*a* sets a folding process mode (Step S401). In this setting of the folding process mode, whether with or without a binding process is set. Then, the CPU 200*a* determines content of this setting, i.e., whether or not to perform a binding process in the folding process (Step S402).

When having determined not to perform a binding process (NO at Step S402), the CPU 200*a* sets the additional folding intensity to "high" (Step S404). On the other hand, when having determined to perform a binding process (YES at Step S402), the CPU 200*a* sets the additional folding intensity to "low" (Step S403). In accordance with this setting, the eccentric cam 262*h* is rotated by the motor 262*j* of the additional folding roller unit 260, thereby the additional folding roller unit 260 is put into "high" or "low" state.

Then, upon completion of an image forming operation of the image forming apparatus PR, the first sheet post-processing apparatus 1 makes a bundle SB of sheets corresponding to one saddle-stitched booklet, and conveys the sheet bundle SB to the saddle-stitch bookbinding apparatus 2 (Step S405). And then, in the case of without a binding process in the saddle-stitch bookbinding apparatus 2, the saddle-stitch bookbinding apparatus 2 performs a folding process on the sheet bundle SB; on the other hand, in the case of with a binding process, the saddle-stitch bookbinding apparatus 2 performs a binding process and a folding process on the sheet bundle SB (Step S406). After the execution of the folding process, in the same manner as at Steps S107 and S108, the saddle-stitch bookbinding apparatus 2 performs additional folding on the sheet bundle SB at the "low" or "high" level of additional folding intensity set at Step S403 or S404 (Step S407), and discharges the sheet bundle SB to the outside of the apparatus (Step S408).

Incidentally, especially when the number of sheets in the sheet bundle SB to be bound is small, there is concern about deformation; therefore, the additional folding intensity can be set in combination with information on the sheet bundle SB, such as sheet number information, thickness information, and a thickness detection result described in FIGS. 33, 34, and 35. Furthermore, even when the sheet bundle SB has been bound, if the thickness of the sheet bundle SB is large, the staple SB3 is less likely to be deformed, and it may be preferable to control the additional folding intensity to be increased.

Therefore, for example, additional folding intensities based on various combinations have been found by experiment, and results of the experiment have been tabulated in a table in advance, and when the CPU 200*a* sets the additional folding intensity, the CPU 200*a* determines the additional folding intensity of a sheet bundle to be additionally-folded with reference to the table. By doing this, a fold SB1 in a sheet bundle SB can be pressed at the appropriate or optimal additional folding intensity, and the fold SB1 can be enhanced.

Figure 37:
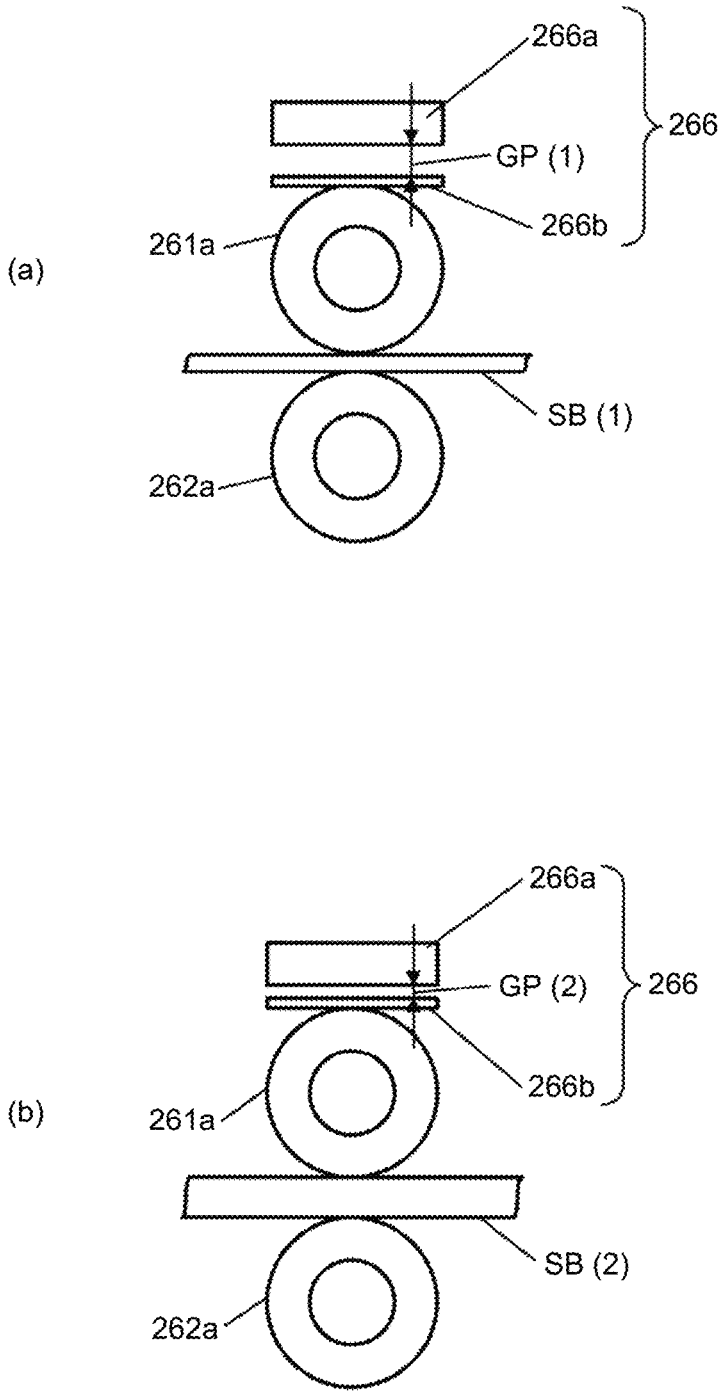
FIG. 37 illustrates a configuration and operation of a thickness sensor.

FIG. 37 illustrates a configuration and operation of the thickness sensor 266 used in the determination at Step S303 in the flowchart illustrated in FIG. 35.

The thickness sensor 266 is composed of a displacement sensor 266*a* and a metal plate 266*b*. The metal plate 266*b* is directly fixed to the top of the upper additional folding roller 261*a*, and is displaced along with displacement of the upper additional folding roller 261*a*. The displacement sensor 266*a* is placed in a preset position separated from the metal plate 266*b* by a gap G. Accordingly, when the thickness of a sheet bundle SB (SB(1) in (a) of FIG. 37) is small, a gap is large as indicated by GP(1). On the other hand, when the thickness of a sheet bundle SB (SB(2) in (b) of FIG. 37) is large, a gap is large as indicated by GP(2).

The displacement sensor 266*a* includes, for example, a coil (not illustrated) on the surface thereof and an oscillation circuit (not illustrated), and applies weak current to the oscillation circuit so that a magnetic field is formed around the coil. Due to the influence of the metal plate 266*b* near the coil, a magnetic flux changes, and this affects the oscillation circuit, and when the distance between the coil and the metal plate 266*b* changes, a frequency changes. Therefore, a gap G between the displacement sensor 266*a* and the metal plate 266*b* fixed to the upper additional folding roller 261*a* is detected by the frequency change, thereby detecting displacement of the upper additional folding roller 261*a*. This displacement is input to the CPU 200*a*, and the CPU 200*a* detects whether a sheet bundle SB is thick or thin or the degree of thickness.

Namely, the thickness of a fold SB1 in a sheet bundle SB conveyed into the additional folding roller unit 260 can be detected by using the thickness sensor 266 structured, for example, like this. Incidentally, the thickness sensor 266 composed of the displacement sensor 266*a* using the coil and the metal plate 266*b* is an example of a means of detecting the thickness of a sheet bundle SB; besides this, a widely-used displacement sensor, such as an ultrasonic sensor, can be used in the thickness sensor 266.

In the flowcharts illustrated in FIGS. 33 to 36, the CPU 200*a* sets the additional folding intensity by using the eccentric cam 262*h* and the motor 262*j* illustrated in FIG. 31. However, if the saddle-stitch bookbinding apparatus 2 is not configured to acquire information on a sheet bundle SB, a user can set or change the additional folding intensity by moving the lower additional folding roller 262*a* as illustrated in FIG. 30.

Incidentally, in known examples, the action of enhancing folding of a fold SB1 by further applying pressure to the fold SB1 is referred to as "folding enhancement". On the other hand, in the present embodiment, the same action is referred to as "additional folding". Both just differ in the form of expression and are practically the same.

Furthermore, in the above-described embodiment, in a state where a sheet bundle SB is at a stop, additional folding is performed by movement of the additional folding roller unit 260; however, a relation between them is relative. Therefore, the additional folding roller unit 260 can be configured so that in a state where the additional folding roller unit 260 is at a stop in a sheet fold direction, the pair of additional folding rollers 261*a* and 262*a* is rotated while pressing a fold SB1 in a sheet bundle SB. This example is illustrated in FIG. 38.

Figure 38:
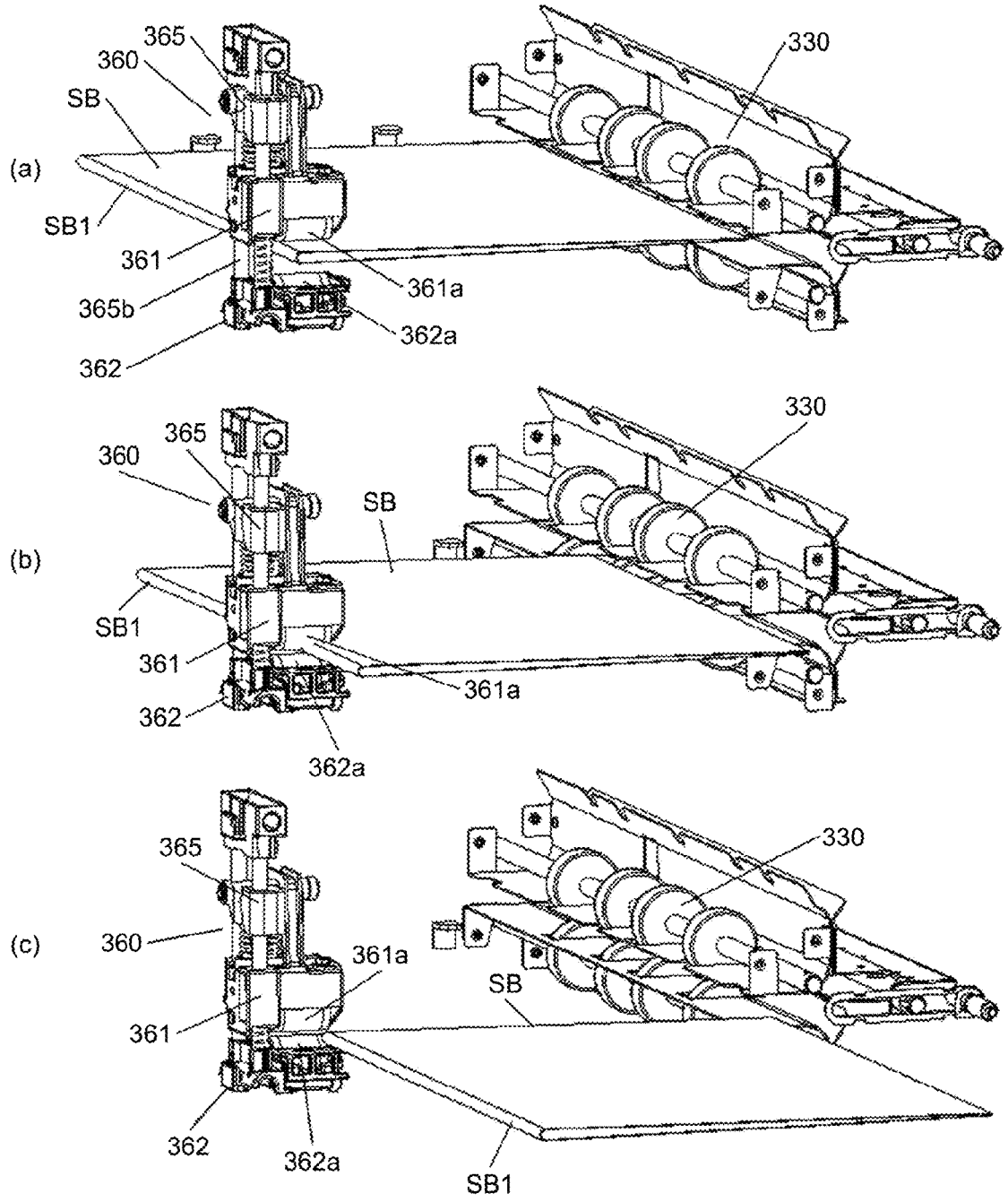
FIG. 38 illustrates an example where the additional folding roller unit performs additional folding in a state where the additional folding roller unit is at a stop in a sheet fold direction.

FIG. 38 illustrates an example where the additional folding roller unit 260 performs additional folding in a state where the additional folding roller unit 260 is at a stop in the sheet fold direction.

In this example, as illustrated in FIG. 38, a sheet bundle SB conveyed through a pair of folding rollers 330 is conveyed toward an additional folding roller unit 360 by a sheet-bundle conveying member (not illustrated). In a state where an upper additional folding roller 361*a* is separated from a lower additional folding roller 362*a* (a pressing cancel state), the additional folding roller unit 360 receives the sheet bundle SB ((a) of FIG. 38). After that, the upper and lower additional folding rollers 361*a* and 362*a* shift into a pressing state ((b) of FIG. 38). Then, the pair of additional folding rollers 261*a* and 262*a* in the pressing state is driven to rotate in sheet fold direction. This conveys the sheet bundle SB in sheet fold direction ((c) of FIG. 38), and, while the sheet bundle SB is being conveyed, additional folding is performed on the fold SB1.

Incidentally, in FIG. 38, a reference numeral 365 denotes a pressing mechanism, a reference numeral 361 denotes an upper additional folding roller unit, a reference numeral 362 denotes a lower additional folding roller unit, and a reference numeral 365*b* denotes a supporting member, and these have the same function as the pressing mechanism 265, the upper additional folding roller unit 261, the lower additional folding roller unit 262, and the supporting member 265*b*, respectively.

As described above, according to the present embodiment, it is possible to achieve the following effects.

(1) The saddle-stitch bookbinding apparatus 2 (a sheet processing apparatus) includes the additional folding roller unit 260 (a pressing unit), which presses a fold SB1 in a folded sheet bundle SB by holding the fold SB1 between the upper additional folding roller 261*a* (a first pressing member) and the lower additional folding roller 261*b* (a second pressing member), and the unit moving mechanism 263 (a moving unit) which moves the pressing position of the additional folding roller unit 260 in a direction of the fold in the sheet bundle SB [a direction of arrow D1]. The saddle-stitch bookbinding apparatus 2 further includes a position changing unit for changing the relative positions of the upper additional folding roller 261*a* and the lower additional folding roller 261*b* in the direction of the fold in the sheet bundle SB, and therefore it is possible to choose emphasis on enhancement of a fold or emphasis on suppression of staple deformation according to the changed position.

(2) The position changing unit sets the upper and lower additional folding rollers 261*a* and 261*b* in the positions at which a first pressing position of the upper additional folding roller 261*a* (the first pressing member) to press the sheet bundle SB and a second pressing position of the lower additional folding roller 261*b* (the second pressing member) to press the sheet bundle SB are shifted with respect to each other in the direction of the fold in the sheet bundle SB [for example, the positions on the straight line Y' illustrated in FIG. 25] or the positions at which the first pressing position and the second pressing position are the same in the direction of the fold in the sheet bundle SB [for example, the positions on the straight line Y illustrated in FIG. 25]; therefore, by selecting either one of the positions, it is possible to choose emphasis on enhancement of a fold or emphasis on suppression of staple deformation.

(3) The position changing unit can change the relative positions n to arbitrary positions; therefore, it is possible to choose emphasis on enhancement of a fold or emphasis on suppression of staple deformation, and also possible to set the degrees of the emphases relatively.

(4) The position changing unit changes the relative positions depending on information on the sheet bundle SB; therefore, it is possible to choose emphasis on enhancement of a fold or emphasis on suppression of staple deformation on the basis of, for example, information on the number of sheets, information on the thickness of sheets set on the sheet tray, and information on the thickness of a sheet bundle, etc.

(5) The position changing unit changes the relative positions depending on information on whether or not to perform a binding process on the sheet bundle SB; therefore, it is possible to choose emphasis on enhancement of a fold or emphasis on suppression of staple deformation depending on whether or not to perform a binding process.

(6) The first pressing member and the second pressing member include the upper additional folding roller 261*a* (a first roller member) and the lower additional folding roller 262*a* (a second roller member) respectively. The position changing unit includes the first and second bearings 262*d* and 262*e* that rotatably support either the upper additional folding roller 261*a* or the lower additional folding roller 262*a* [the lower additional folding roller 262*a* in FIGS. 25 and 30], and causes the shaft 262*g* of the upper additional folding roller 261*a* (the first roller member) or the shaft 262*g* of the lower additional folding roller 262*a* (the second roller member) [the shaft 262*g* of the lower additional folding roller 262*a* in FIGS. 25 and 30] to be located in either the first bearing 262*d* or the second bearing 262*e*, thereby changing the relative positions; therefore, it is possible to choose emphasis on enhancement of a fold or emphasis on suppression of staple deformation just by selecting a bearing.

Furthermore, all we have to do is form the first and second bearings 262*d* and 262*e* in advance as the position changing unit; therefore, it is possible to provide the saddle-stitch bookbinding apparatus 2 at low cost. Moreover, no electric power is consumed in the position change, and no running cost is necessary. At this time, if three or more bearings are formed, fine adjustment of the angle η is also possible.

(7) The position changing unit includes the cover 262*d* formed of an elastic body; the cover 262*d* is opened when the shaft 262*g* is moved, and closed after the shaft 262*g* has been moved and rotatably holds the shaft 262*g* in the bearing 262*d* or 262*e*. Therefore, by opening and closing of the cover 262*b*, it is possible to easily choose emphasis on enhancement of a fold or emphasis on suppression of staple deformation in accordance with user's intention. Furthermore, the lower additional folding roller 262*a* is removably attached to a bearing, and therefore a user can easily replace the lower additional folding roller 262*a* when the lower additional folding roller 262*a* is worn down.

(8) The position changing unit includes the guide surface 262*k* (a guide unit) that guides either one of the upper and lower additional folding rollers 261*a* and 262*a* to be moved parallel to a moving direction of the unit moving mechanism 263 (the moving unit) and the eccentric cam 262*h* and the motor 262*j* or a solenoid (a cam unit) that reciprocate the lower additional folding roller 262*a* (one of the additional folding rollers) along the guide surface 262*k*; therefore, it is possible to choose emphasis on enhancement of a fold or emphasis on suppression of staple deformation by the motor driving the lower additional folding roller 262*a*, thereby changing the position of the lower additional folding roller 262*a* in accordance with user operation input through the operation panel.

(9) The additional folding roller unit 260 includes the guide path 270 (a pressing drive unit) for the additional folding roller unit 260 (a pressing unit) to start pressing and cancel the pressing; therefore, the pressing start position and the pressing cancel position can be arbitrarily set according to the shape of the guide path 270.

(10) When the additional folding roller unit 260 (the pressing unit) moves forward from the side of one end SB2*a* of a sheet bundle SB, the additional folding roller unit 260 starts pressing at the position separated by a distance La from the end SB2 of the sheet bundle SB in the width direction of the sheet bundle SB [a direction D1] (a preset first position), and after having passed through the other end SB2*b* of the sheet bundle SB, the additional folding roller unit 260 cancels the pressing, and then, when the additional folding roller unit 260 moves backward from the side of the other end SB2*b*, the additional folding roller unit 260 starts pressing at the position separated by a distance Lb from the end SB2*b* (a preset second position), and passes through the other end SB2*b* of the sheet bundle SB; therefore, when the additional folding roller unit 260 moves from the outside of the end SB2 of the sheet bundle SB, the additional folding roller unit 260 is always in the pressing cancel state, and never causes damage to the end SB2 of the sheet bundle SB when performing additional folding on a fold SB1 in the sheet bundle SB.

Furthermore, the additional folding roller unit 260 does not perform additional folding on the entire area of the sheet bundle SB in the width direction at once; therefore, it is possible to suppress the occurrence of curling or a wrinkle in the fold SB1 and its vicinity due to the accumulation of twisting.

Incidentally, in the above explanation of the effects in the embodiment, each unit in the present embodiment is described together with an element in claims enclosed in parentheses or is denoted by a reference numeral so as to clear a correspondence relation between the two. In addition, the correspondence to the embodiment is enclosed in square brackets as needed.

According to the embodiments, it is possible to choose emphasis on enhancement of a fold or emphasis on suppression of staple deformation in accordance with user's intention.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus, comprising:

a pressing unit including a first pressing member and a second pressing member, the pressing .unit being configured to press a fold in a folded sheet bundle by holding the fold between the first pressing member and the second pressing member;

a moving unit configured to move a pressing position of the pressing unit in a direction of the fold in the sheet bundle; and a position changing unit configured to change relative positions of the first pressing member and the second pressing member in the direction of the fold in the sheet bundle, wherein the position changing unit is configured to change the relative positions to arbitrary positions.

2. The sheet processing apparatus according to claim 1, wherein the position changing unit is configured to set the first pressing member and the second pressing member in positions at which a first pressing position of the first pressing member to press the sheet bundle and a second pressing position of the second pressing member to press the sheet bundle are shifted with respect to each other ,in the direction of the fold in the sheet bundle or positions at which the first pressing position and the second pressing position are same in the direction of the fold in the sheet bundle.

3. The sheet processing apparatus according to claim 1, wherein the position changing unit is configured to change the relative positions depending on information on the sheet bundle.

4. The sheet processing apparatus according to claim 1, wherein the position changing unit is configured to change the relative positions depending on information on whether or not to perform a binding process on the sheet bundle.

5. The sheet processing apparatus according to claim 1, wherein the position changing unit includes a guide unit configured to guide one of the first pressing member and the second pressing member to be moved in the direction of the fold; and a cam unit configured to move the one of the first pressing member and the second pressing member along the guide unit.

6. The sheet processing apparatus according to claim 1, wherein the position changing unit includes a guide unit configured to guide one of the first pressing member and the second pressing member to be moved in the direction of the fold; and a solenoid configured to move the one of the first pressing member and the second pressing member along the guide unit.

7. An image forming .system, comprising:

the sheet processing apparatus according to claim 1.

8. A sheet processing apparatus comprising:

a pressing unit including a first roller and a second roller, the pressing unit being configured to press a fold in a folded sheet bundle by holding the fold between the first roller and the second roller;

a moving unit configured to move a pressing position of the pressing unit in a direction of the fold in the sheet bundle; and a position changing unit configured to change relative positions of the first roller and the second roller in the direction of the fold in the sheet bundle, wherein the position changing unit includes a first bearing and a second bearing for rotatably supporting one of the first roller and the second roller, and the position changing unit is configured to causes a shaft of the one of one of the first roller and the second roller to be located in one of the first bearing and the second bearing to change the relative positions.

9. The sheet processing apparatus according to claim 8, wherein the position changing unit includes a cover formed of an elastic body, the cover being opened to move the shaft, the cover being closed and rotatably holding the shaft in the one of the first bearing and the second bearing after the shaft has been moved.

10. An image forming system, comprising:

the sheet processing apparatus according to claim 8.

11. A sheet processing apparatus comprising:

a pressing unit including a first pressing member and a second pressing member, the pressing unit being configured to press a fold in a folded sheet bundle by holding the fold between the first pressing member and the second pressing member;

a moving unit configured to move a pressing position of the pressing unit in a direction of the fold in the sheet bundle;

a position changing unit configured to change relative positions of the first pressing member and the second pressing member in the direction of the fold in the sheet bundle; and a pressing drive unit configured to cause the pressing unit to start pressing and cancel the pressing.

12. The sheet processing apparatus according to claim 11, wherein the pressing unit is configured to start pressing from a preset first position in a width direction of the sheet bundle when the pressing unit moves forward, and cancel the pressing after having passed through one end of the sheet bundle, and the pressing unit is configured to start pressing from a preset second position when the pressing unit moves backward, and pass through the other end of the sheet bundle.

13. An image forming system, comprising:

the sheet processing apparatus according to claim 11.

* * * * *